US006431247B1

(12) United States Patent
Harrison, Jr. et al.

(10) Patent No.: US 6,431,247 B1
(45) Date of Patent: Aug. 13, 2002

(54) WINDOW TREATMENT HOLDER SYSTEM

(76) Inventors: John Edward Harrison, Jr., 111 E. Augusta Pl., Greenville, SC (US) 29605; William Craig Marchant, 23 Craigwood Ct., Greenville, SC (US) 29607

( * ) Notice: Subject to any disclaimer, the term of this patent is extended or adjusted under 35 U.S.C. 154(b) by 0 days.

(21) Appl. No.: 09/533,757

(22) Filed: Mar. 23, 2000

Related U.S. Application Data

(60) Provisional application No. 60/126,020, filed on Mar. 25, 1999.

(51) Int. Cl.[7] ..... E06B 9/30

(52) U.S. Cl. ..... 160/168.1 R; 160/178.1 R; 248/262; 52/39

(58) Field of Search ..... 160/178.1, 902, 160/330; 248/262; 16/94 R; 211/105.1; 52/39

(56) References Cited

U.S. PATENT DOCUMENTS

| | | | | |
|---|---|---|---|---|
| 3,346,909 A | * | 10/1967 | Blackburn | |
| 3,678,636 A | | 7/1972 | Cohen | 52/39 |
| 3,708,927 A | | 1/1973 | Cohen | 52/39 |
| 3,715,776 A | | 2/1973 | Tanaka | 16/94 D |
| 3,951,197 A | | 4/1976 | Cohen et al. | 160/346 |
| 4,023,235 A | | 5/1977 | Cohen et al. | 16/94 D |
| 4,224,974 A | * | 9/1980 | Anderson et al. | |
| 4,886,102 A | | 12/1989 | Debs | 160/177 |
| 5,522,444 A | * | 6/1996 | Liu | |
| 5,533,560 A | * | 7/1996 | Morris | |

FOREIGN PATENT DOCUMENTS

| | | | |
|---|---|---|---|
| AU | 57823/73 | 1/1975 | 81/5 |
| AU | B-54837/90 | 3/1991 | E06B/9/323 |
| CA | 946577 | 5/1974 | 20/18 |

* cited by examiner

*Primary Examiner*—Blair M. Johnson

(57) ABSTRACT

A window treatment holding system having an elongated pocket member defining a pocket profile, or structure, in which a bracket is received in a snap-fit arrangement. The system is capable of generally concealing the mechanical portion of a window treatment and includes the bracket being designed to carry the head rail of a conventional horizontal or vertical blind, or a drapery rod or channel. The pocket member can be of a variety of configurations and can be fastened over a window, in the ceiling, fastened to the wall or window frame adjacent the window, or incorporated into the window mullion head. Various pocket profiles are provided, some designed to be concealed from view, and others having decorative external portions for providing an aesthetically appealing appearance. The pocket member could be molded or extruded as a part of a window frame or the window mullion head. Also, the pocket profile can be created using a pocket adapter and snapped into place in a conventional mullion cavity.

22 Claims, 29 Drawing Sheets

WINDOW TREATMENT HOLDER SYSTEM

This application claims the benefit of U.S. Provisional application Ser. No. 60/126,020, filed Mar. 25, 1999, entitled "Window Treatment Holder System."

BACKGROUND OF THE INVENTION

This invention relates generally to a system for mounting and retaining window treatments, such as horizontal blinds, vertical blinds, draperies, shades, shutters, sliding fabric panels, etc.

When installing window treatments in a new or existing structure, several options are available. With regard to installing horizontal blinds, for example, dedicated brackets provided by the manufacturer are generally fastened, such as with screws or other fasteners, to window frame or to wall or ceiling portions surrounding the corresponding window. Similarly, when installing draperies, drapery rods may also be directly fastened to window frame or to wall or ceiling surfaces surrounding the window with dedicated brackets using conventional fasteners.

Other installation conditions are common. One option involves the construction of an oversized pocket or soffit for concealing the upper portion of the window treatment. This pocket is typically built into the structure using wallboard, studs, etc. Another option is the use of a prefabricated pocket, which can be structured of metal such aluminum.

Another option is the use of a channel member, which also can be structured of metal such as aluminum, which may be provided by a manufacturer of the window treatment and which is configured specifically for that manufacturer's product.

Some of the foregoing options may be expensive, labor intensive to install, and/or of limited use for different types of window treatments.

Master Recessed Systems has offered pocket structures for holding venetian blinds, draperies and vertical blinds. Note in particular U.S. Pat. Nos. 3,678,636 and 3,708,927, both of which issued to Cohen. Note also U.S. Pat. Nos. 3,951,197 and 4,023,235, both of which issued to Cohen, et al. Concerning existing window treatment holders, other window treatment manufacturers offered brackets that twist into place using a tool and which hold window treatments, such as horizontal blinds, in place.

Other patented devices are disclosed in U.S. Pat. No. 4,886,102, issued to Debs which describes a support for a venetian blind, and also U.S. Pat. No. 3,715,776, issued to Tanaka, which discloses a curtain box. Australian Patent Document Nos. 54,837/90 and 57,823/73 disclose related devices.

Even in view of the foregoing devices, there still exists a need for advancements in window treatment holding systems. A particular need exists for a system which is easily installed with a minimal number of fasteners, and which finds more universal application among various types of window treatments produced by various manufacturers.

SUMMARY OF THE INVENTION

It is, therefore, the principal object of this invention to provide a window treatment holding system which can be used to install multiple types of window treatments produced by various manufacturers.

Another object of the present invention is to provide a window treatment holding system which can be incorporated in the top of the window mullion, mounted overhead, or surface mounted.

Yet another object of the present invention is to provide a window treatment holding system having a pocket member which finds widespread applicability for use in retaining various types and styles of window treatments.

Another object of the present invention is to provide a window treatment holding system having brackets tailored for specific window treatments, such brackets being usable in a particular embodiment of a pocket member constructed in accordance with the present invention.

A further object of the present invention is to provide brackets which position the window treatment within a pocket member.

A still further object of the present invention is to provide means for a given pocket configuration to allow various types of products to be installed using appropriate brackets of the present invention.

Yet a further object of the present invention is to provide a method of using a window treatment holding system constructed in accordance with the present invention.

Generally, the present invention includes an elongated pocket member defining a pocket profile, or structure, in which a bracket is received in a snap-fit arrangement. The bracket is designed to carry the head rail of a conventional horizontal or vertical blind, or a drapery rod or channel.

The pocket member can be of a variety of configurations and can be fastened over a window, in the ceiling, fastened to the wall or window frame adjacent the window, or incorporated into the window mullion head. Numerous pocket profiles are provided, some of which are designed to be concealed from view, and others having decorative external portions for providing an aesthetically appealing appearance. The pocket member is fixed to the desired location using conventional fasteners, such as screws, bolts, rivets or the like, or, in certain applications, could be molded or extruded as a part of a window frame or the window mullion head. Also, the pocket profile can be provided by a pocket adapter and snapped into place in a conventional mullion cavity.

The brackets also come in numerous designs, some of which are shown in the figures provided herewith. The brackets are "snapped" or "twisted" into place within a pocket member, allowing for a window treatment to be snapped into the pocket/bracket system. Alternately, the brackets can be attached to a window treatment head prior to its insertion into the pocket member. Neither screws, bolts nor other fasteners or tools are necessary in order to couple the window treatment to the pocket. Further, the brackets are preferably designed such that the window treatments may be removed or adjusted once coupled with the pocket member.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
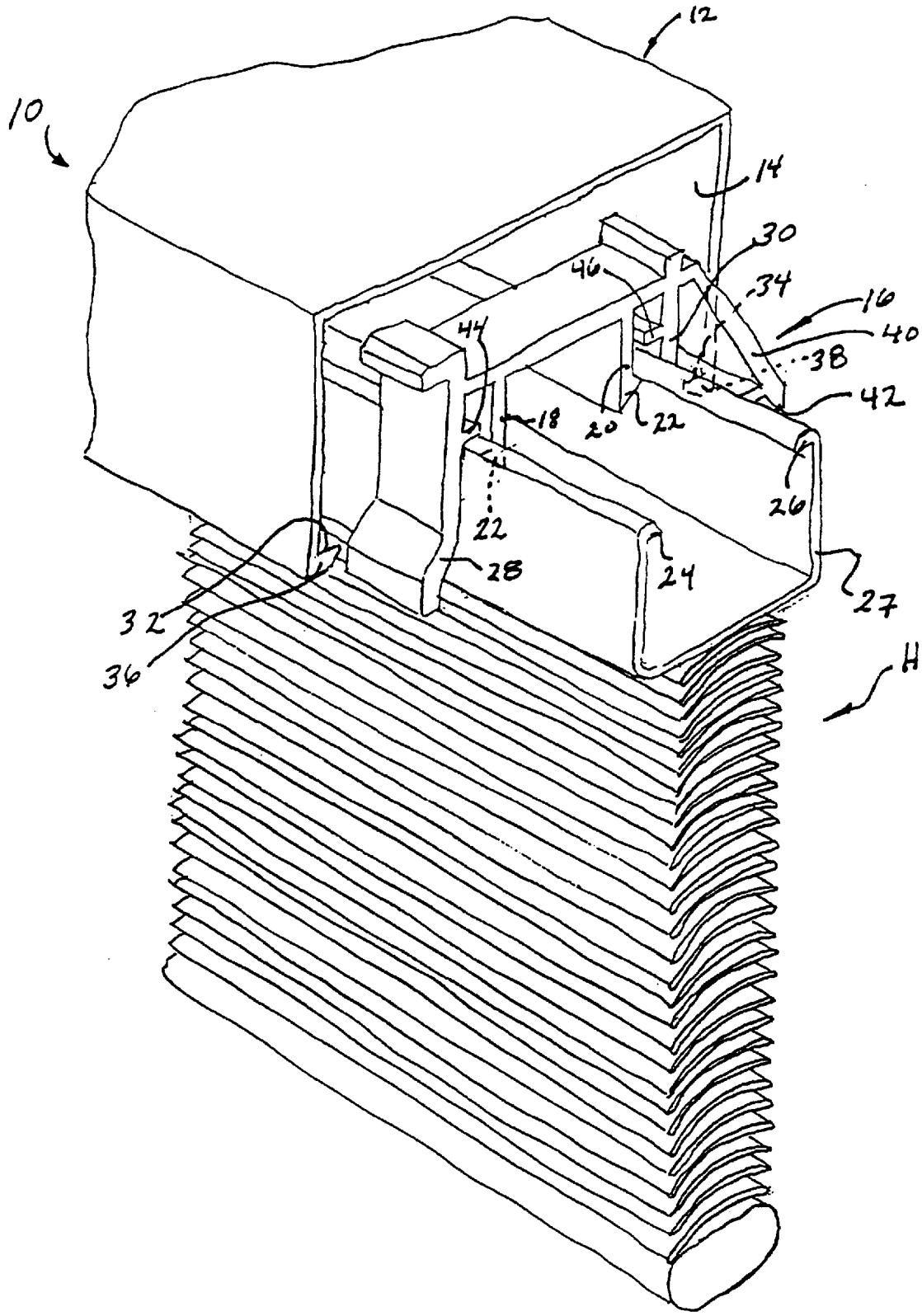
FIG. 1 is a perspective view of a window treatment holding system constructed in accordance with the present invention, and illustrates a pocket member and bracket of the present invention holding a conventional set of horizontal blinds.

The accompanying drawings and the description which follows set forth this invention in its preferred embodiment. However, it is contemplated that persons generally familiar with window treatments will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the window treatment holding system of the present invention is indicated generally in the figures by reference character 10.

Figure 2:
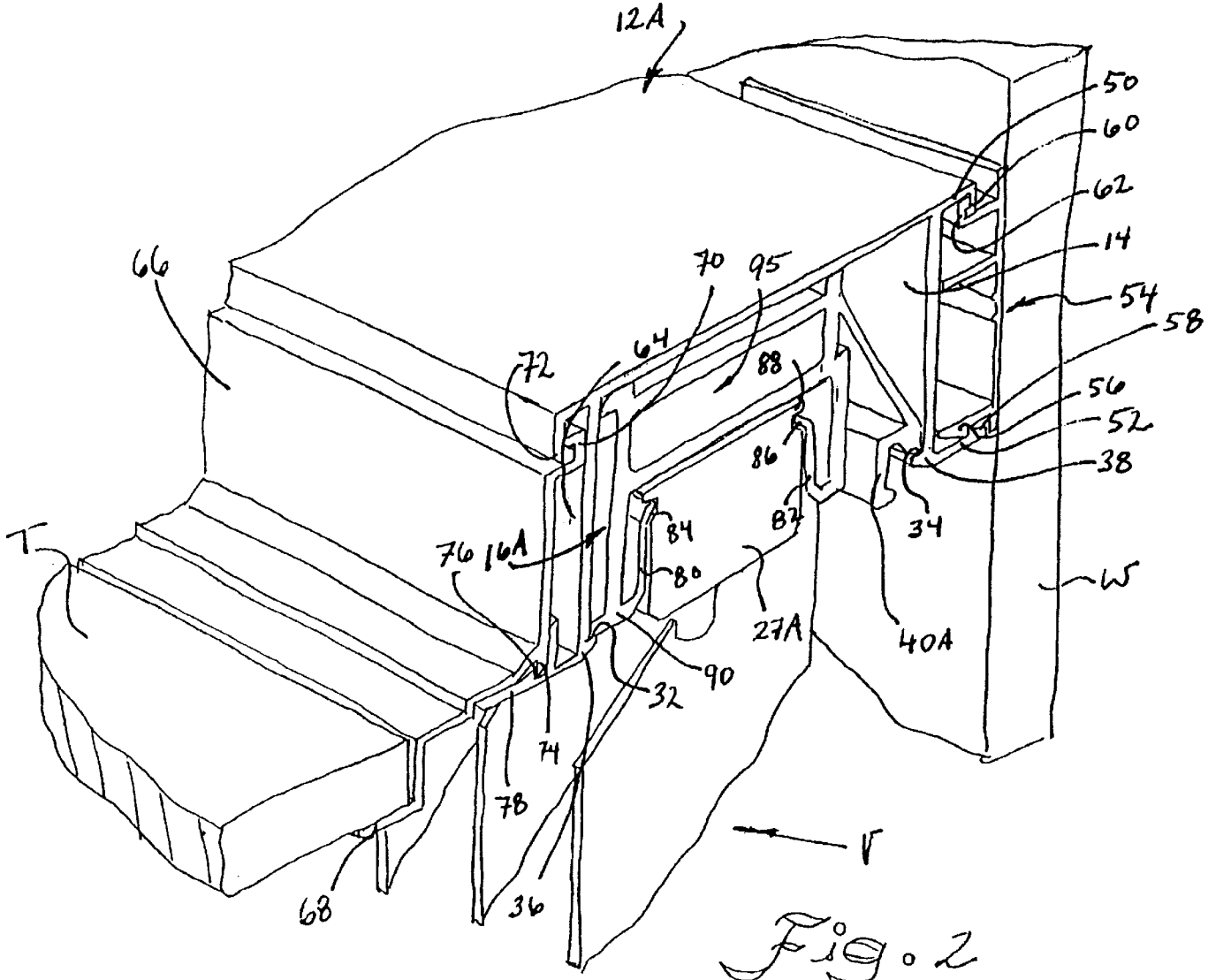
FIG. 2 is a partial perspective view of a window treatment holding system constructed in accordance with the present invention, illustrating an alternate embodiment pocket member and an alternate embodiment bracket of the present invention holding a conventional set of vertical blinds.

FIGS. 1 and 2 illustrate two of the fundamental configurations of the present invention. FIG. 1 illustrates window treatment holder system 10 supporting a set of horizontal blinds H. Pocket member, generally 12, defines an elongated channel 14 for receipt of a bracket, generally 16. It is to be noted at the outset that the configuration of pocket member 12 and bracket 16 can be varied significantly, while still not departing from the scope of the present invention.

Bracket 16 is preferably made of a flexible, resilient material such as plastic, although it is to be understood that metal, wood, or some other suitable material having sufficient resiliency and structural integrity could also be used. Bracket 16 includes downwardly extending arms 18, 20, each having a barb 22 at the end thereof. Each barb 22 receives and supports inwardly turned upper flange portions 24, 26 of a head rail 27 of blinds H. Outer arms 28, 30 are provided, and arm 28 rests on ledge 32 of pocket member 12. Ledge 32 and a ledge 34 are formed by flanges 36, 38 of pocket member 12.

Pocket member 12 is preferably formed of extruded aluminum, although it is to be understood it could be fabricated in some other suitable manner and of some other material, such as another metal besides aluminum. Pocket member 12, for example, could be potentially extruded or molded of plastic, if desired.

Figure 5:
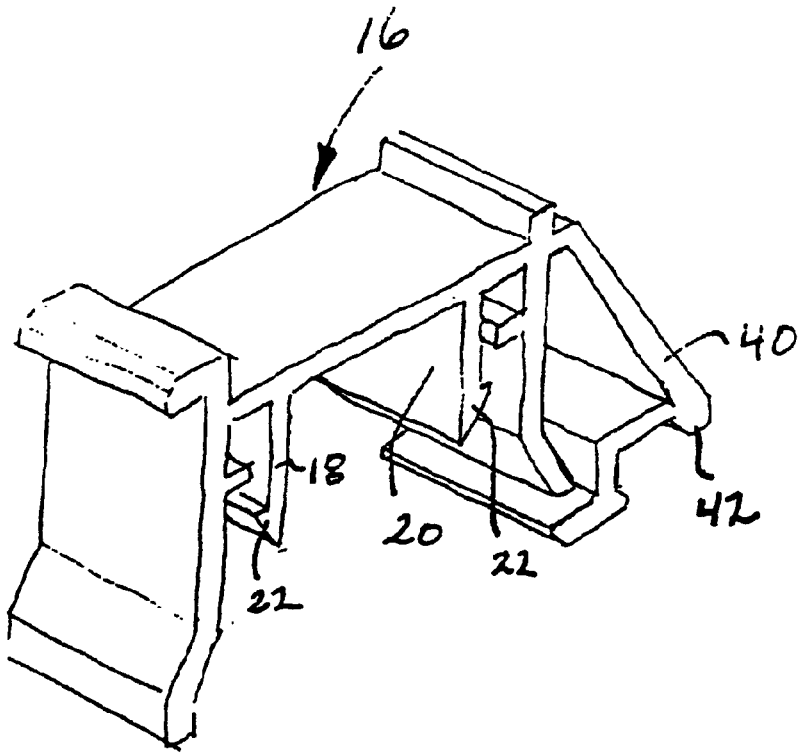
FIG. 5 is a perspective view of a bracket constructed in accordance with the present invention.

As shown in FIGS. 1 and 5, bracket 16 includes an elongated flexible catch member 40 which has a lower edge portion 42 which rests on ledge 34 when bracket and blinds H have been installed in pocket member 12.

When it is desired to hang blinds H, bracket 16, because it is flexible, is snapped onto head rail 27 such that barbs 22 engage flanges 24, 26 of head rail 27. Stops 44, 46 limit upward movement of head rail 27, once barbs 22 have engaged flanges 24, 26. Bracket 16 is then inserted into pocket channel 14, and flexible catch is simultaneously pressed inwardly toward head rail 27 such that the lower edge 42 thereof clears flange 38 and edge 42 rests on ledge 34. Once this occurs, flexible catch 40 is released, and bracket 16, and accordingly, head rail 27 and blinds H, are securely held within pocket member 12. If it is desired to remove blinds H, flexible catch 40 is depressed to the extent necessary that lower edge 42 clears flange 38, thereby releasing bracket 16 from pocket member 12. Although the present invention discloses numerous pocket and bracket configurations herein, the basic operation of the pocket and bracket designs of the present invention operate substantially the same as that just discussed.

Turning now to FIG. 2, alternate embodiments of the pocket member and bracket of the present invention will be discussed. In this embodiment, pocket member 12A includes substantially the same inner "pocket structure," as discussed above, i.e., the pocket structure including a channel 14 provided with support ledges 32, 34 formed by inwardly extending flanges 36, 38, respectively. In the FIG. 2 embodiment, pocket member 12A includes rearwardly extending flanges 50, 52 which engage in an interlocking relationship with a bracket, generally 54 mounted on a wall W. Bracket 54 includes a lower barbed portion 56 which engages a corresponding barbed portion 58 of flange 52 in a snap fit relationship. Upper flange 50 includes a hook portion 60 which engages with a corresponding hook portion 62 of bracket 54. On the other end of pocket member 12A, a recess 64 is provided in which a support member 66 has a lip 68 for supporting a ceiling panel or tile, generally T. Support member 66 includes a hook portion 70 which corresponds with a hook portion 72 of pocket member 12A. Support member 66 also includes a barbed edge 74 which is received in a barb/groove combination 76 defined in a flange 78 of pocket member 12A. It is noted that pocket member 12A can be securely retained to bracket 54 by the snap fit interaction of barbs 56 and 58. Likewise, support member 66 is retained on pocket member 12A by the snap fit arrangement of barb 74 with barb/groove combination 76.

Bracket 16A includes a flexible catch 40A and snaps into place within pocket member 12A upon a vertical blind V head rail 27A being received by upstanding flexible arms 80, 82. Arms 80, 82 have at their extreme end inwardly curved catches 84, 86, respectively, which engage outwardly extending lip portions 88 of head rail 27. The lower end of catch 84 and the lower end of leg 90 of bracket 16A rest on ledges of the pocket structure of pocket member 12A.

Figure 3:
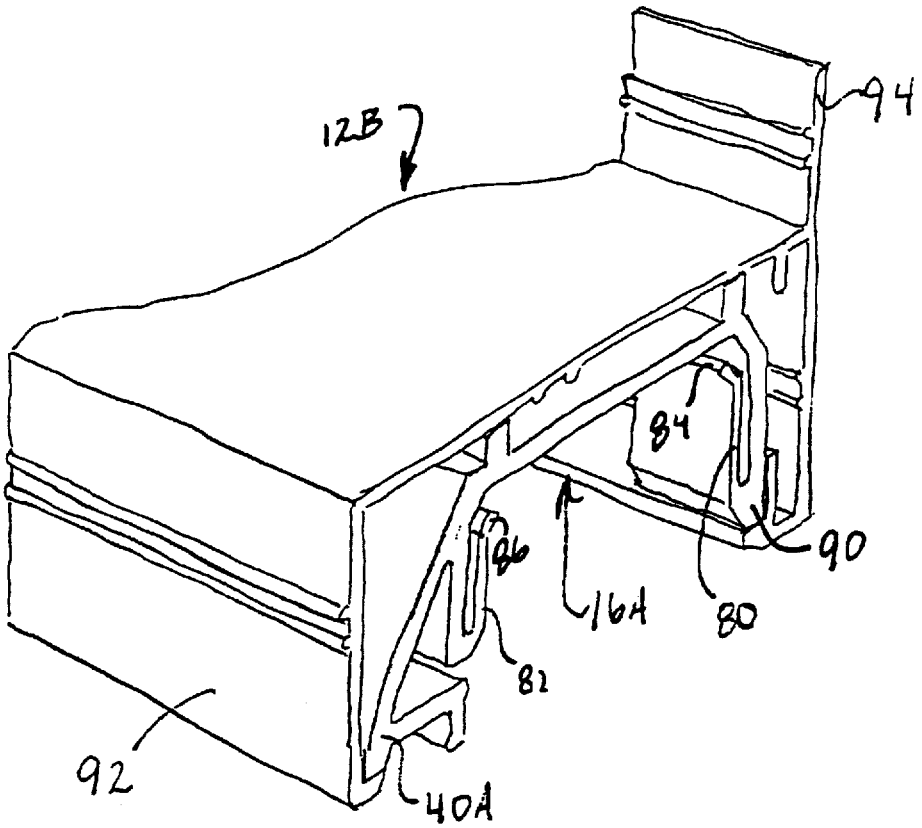
FIG. 3 is a partial perspective view of a pocket member and bracket constructed in accordance with the present invention.

FIG. 3 illustrates a pocket member 12B having a front portion 92 and a rear upstanding portion 94 which can be used to attach pocket member 12B to a wall using conventional fasteners (not shown). Bracket 16A refers to a family of brackets, and in FIG. 3 bracket 16A has been modified to eliminate cavity 95 (FIG. 2), and is provided in pocket member 12B, but as compared with FIG. 2, the bracket 16A is reversed, with the catch 40A being adjacent the front 92 of pocket member 12B, instead of the rear. Because bracket 16A is asymmetric, reversing of the bracket 16A, as shown in FIG. 6, allows for the distance between the window treatments, such as vertical blinds V from the wall W or window (not shown) to be varied for clearance, aesthetic, or other purposes.

Figure 4:
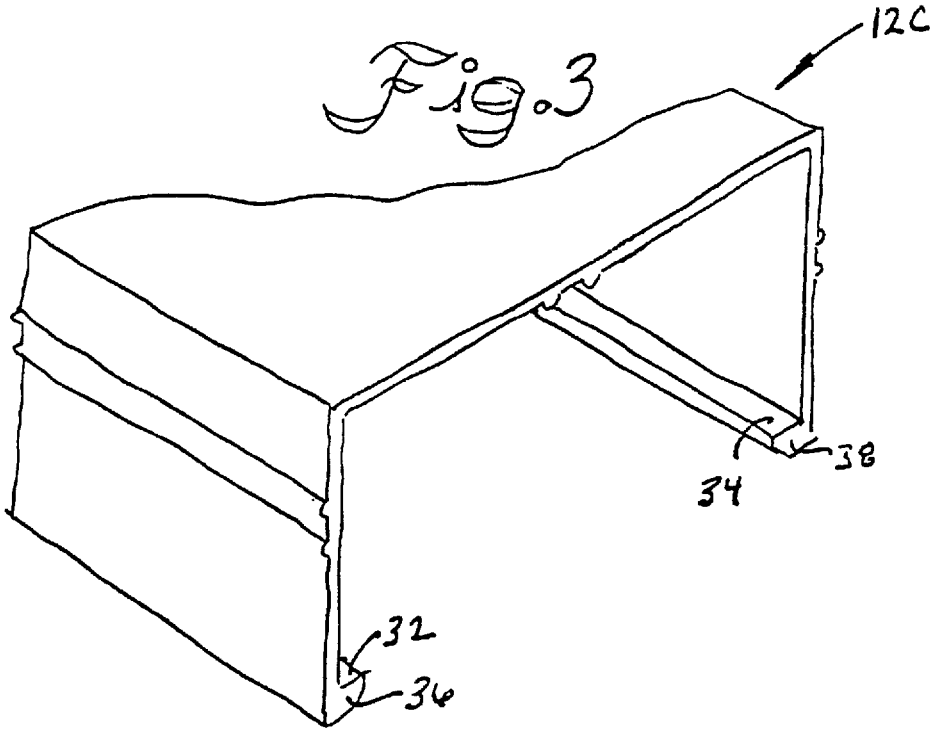
FIG. 4 is a partial perspective view of a pocket member constructed in accordance with the present invention.

FIG. 4 illustrates pocket member 12C, which is similar to pocket member 12 and includes the basic pocket structure discussed above.

FIG. 5 illustrates bracket member 16 prior to insertion into a window treatment and also prior to insertion into pocket member 12.

Figure 6:
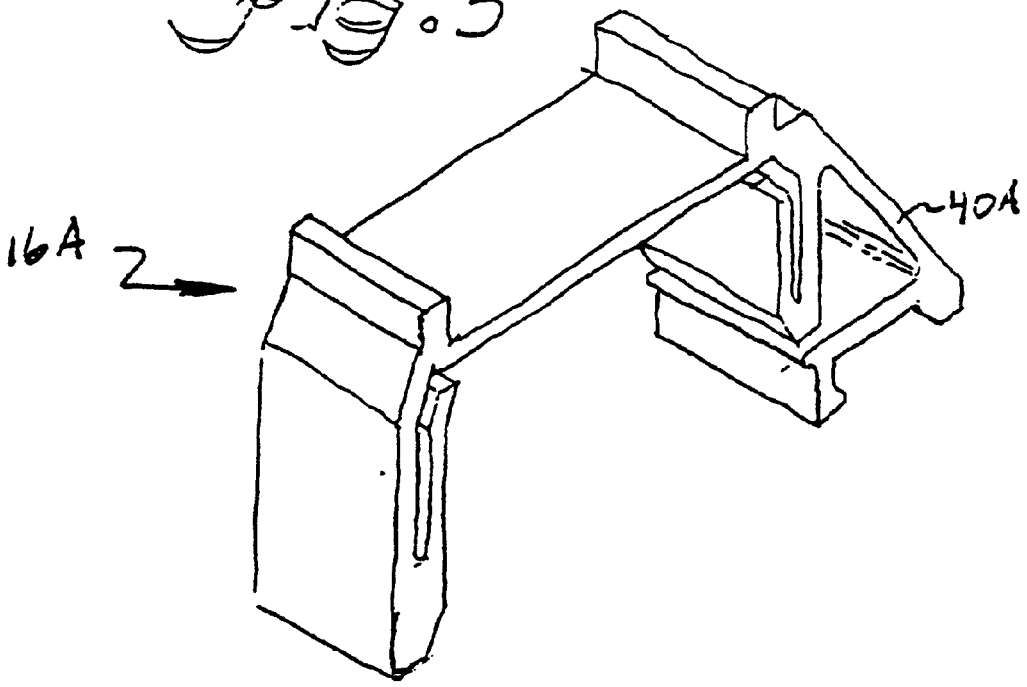
FIG. 6 is a perspective view of an alternate embodiment of a bracket constructed in accordance with the present invention.

FIG. 6 illustrates bracket member 16A prior to insertion into a window treatment and prior to insertion of bracket 16A into pocket member 12.

Figure 7:
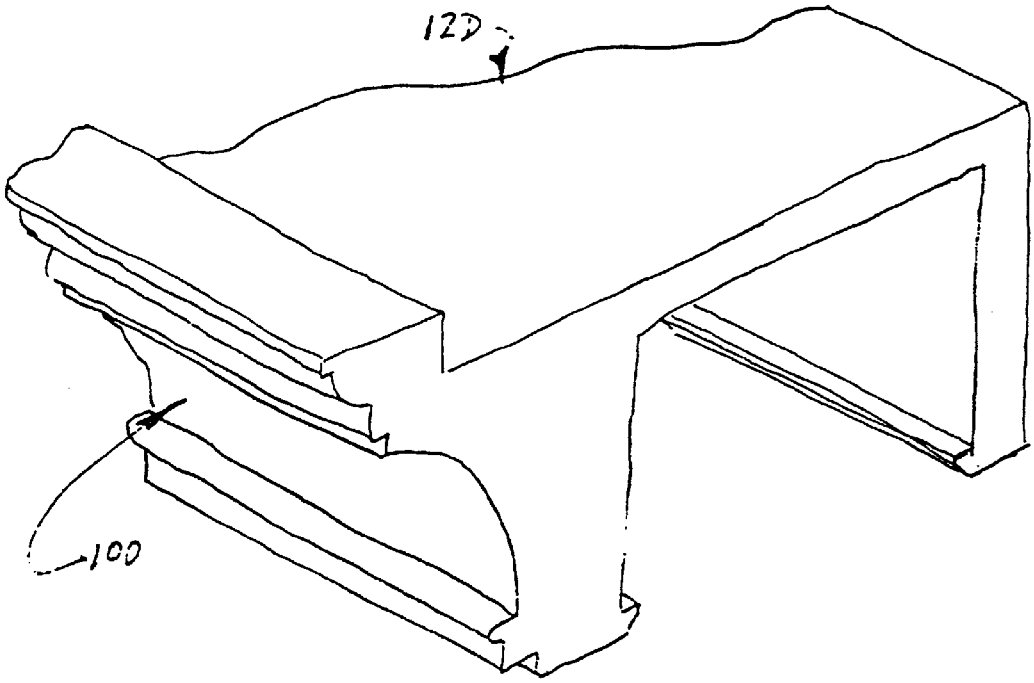
FIG. 7 is a perspective view of an alternate embodiment of a pocket member constructed in accordance with the present invention having unitary decorative molding defined therein.

FIG. 7 illustrates a pocket member 12D having a decorative crown molding profile 100 being integral therewith. In this embodiment, the pocket member and crown molding 100 could be extruded, or otherwise formed, as a single unit, thereby improving efficiency of construction and also providing increased aesthetic possibilities.

Figure 8:
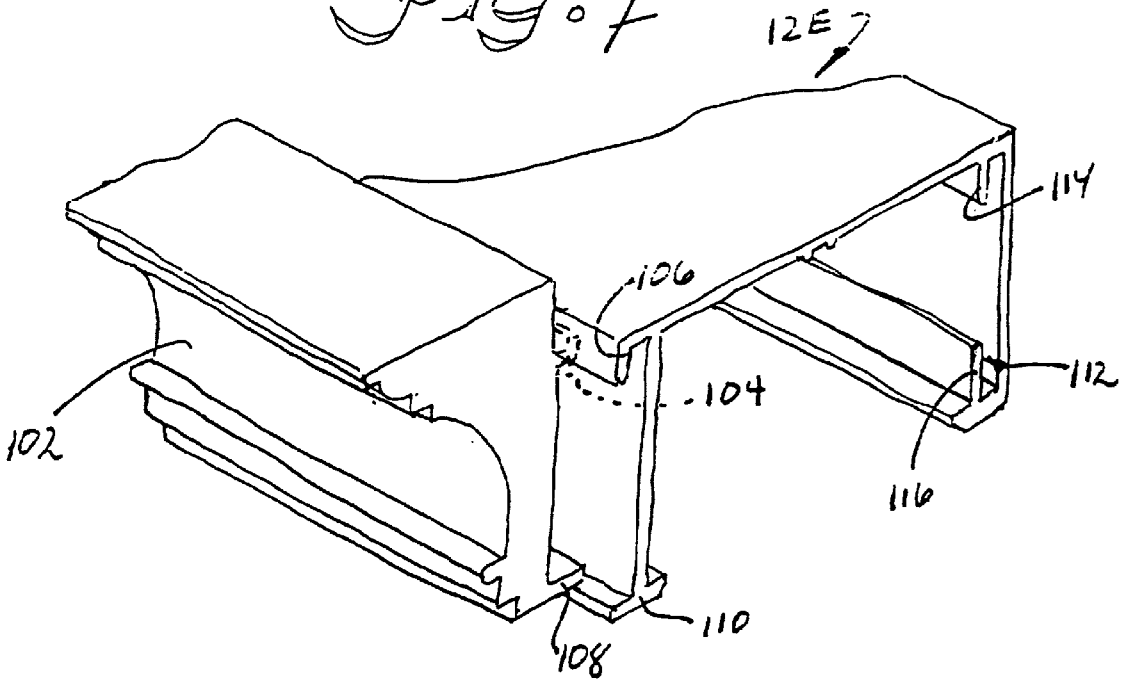
FIG. 8 is a partial perspective view of a pocket member constructed in accordance with the present invention having a separate decorative molding member attached hereto.

FIG. 8 illustrates pocket member 12E having a separate crown molding member 102 attachable thereto. Crown molding 102 includes a hook portion 104 which engages hook portion 106 of pocket member 12E. The lower end of molding 102 includes a flange 108 which rests upon flange 110 of member 12E. Pocket member 12E also includes a channel 112, formed by legs 114 and 116 which can receive a joining, or splicing, member 118 (FIG. 13) when the plurality of pocket members 12E are to be joined together in an end to end relationship.

Figure 9:
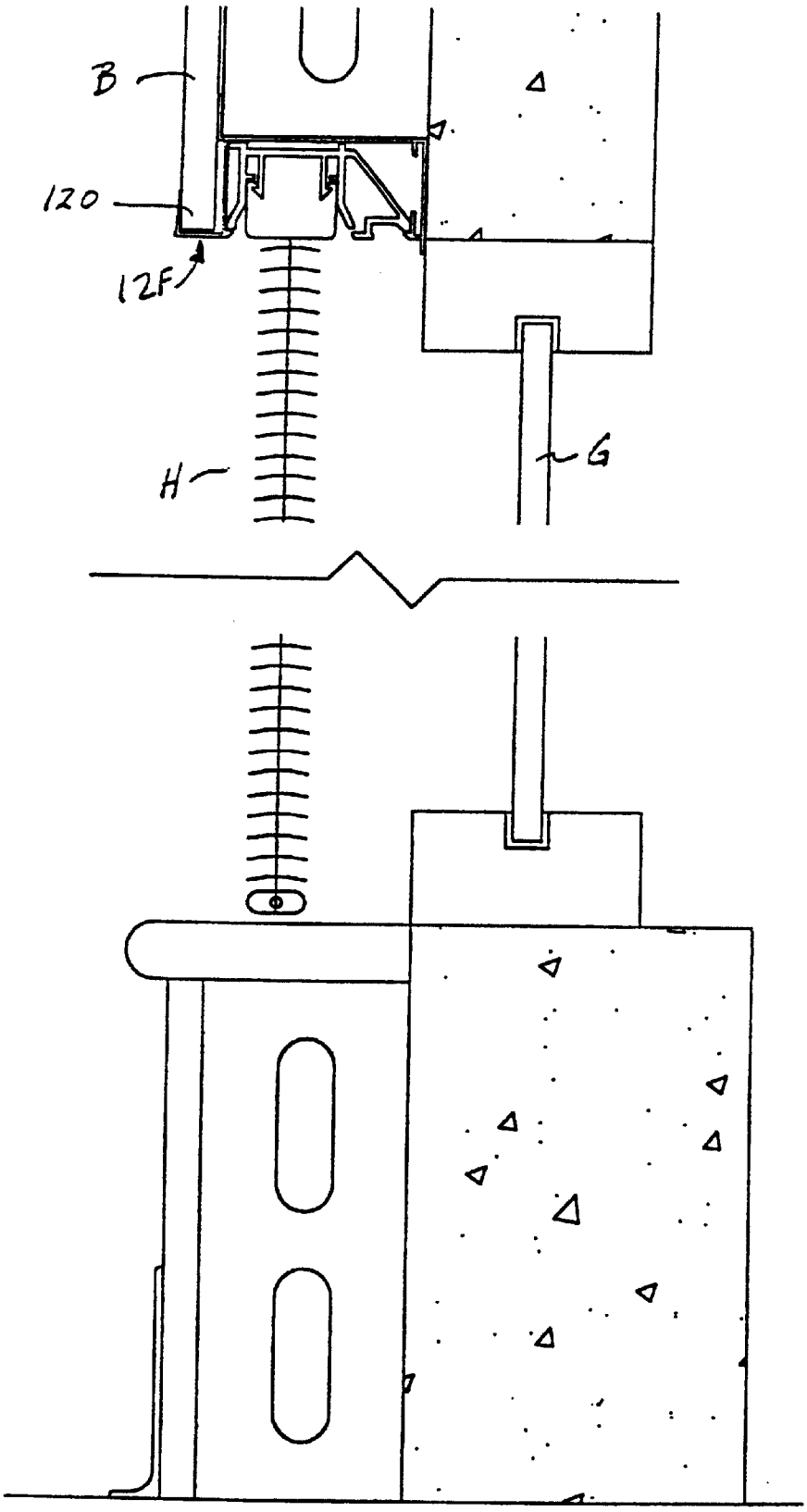
FIG. 9 is a sectional view of an alternate embodiment pocket member of the present invention in use with a horizontal blind.

FIG. 9 illustrates a pocket member 12F having a channel 120 for receipt of a wall board member B, and the basic bracket 16 to support horizontal blinds H from the glass G of a window.

Figure 10:
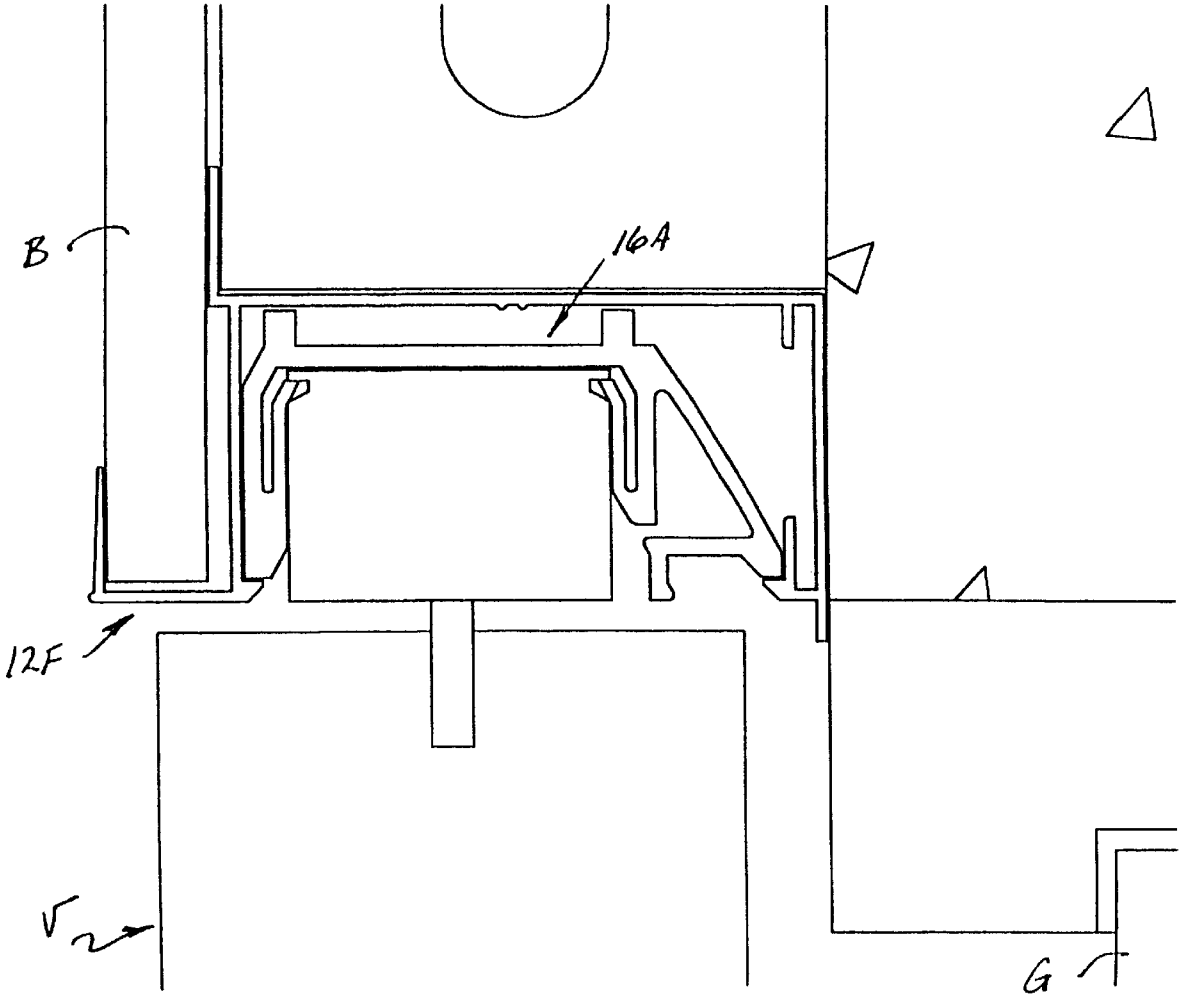
FIG. 10 is a sectional view of the pocket member of FIG. 9 in use with a vertical blind set.

FIG. 10 illustrates pocket member 12F being used with bracket 16A in order to hold a set of vertical blinds V.

Figure 11:
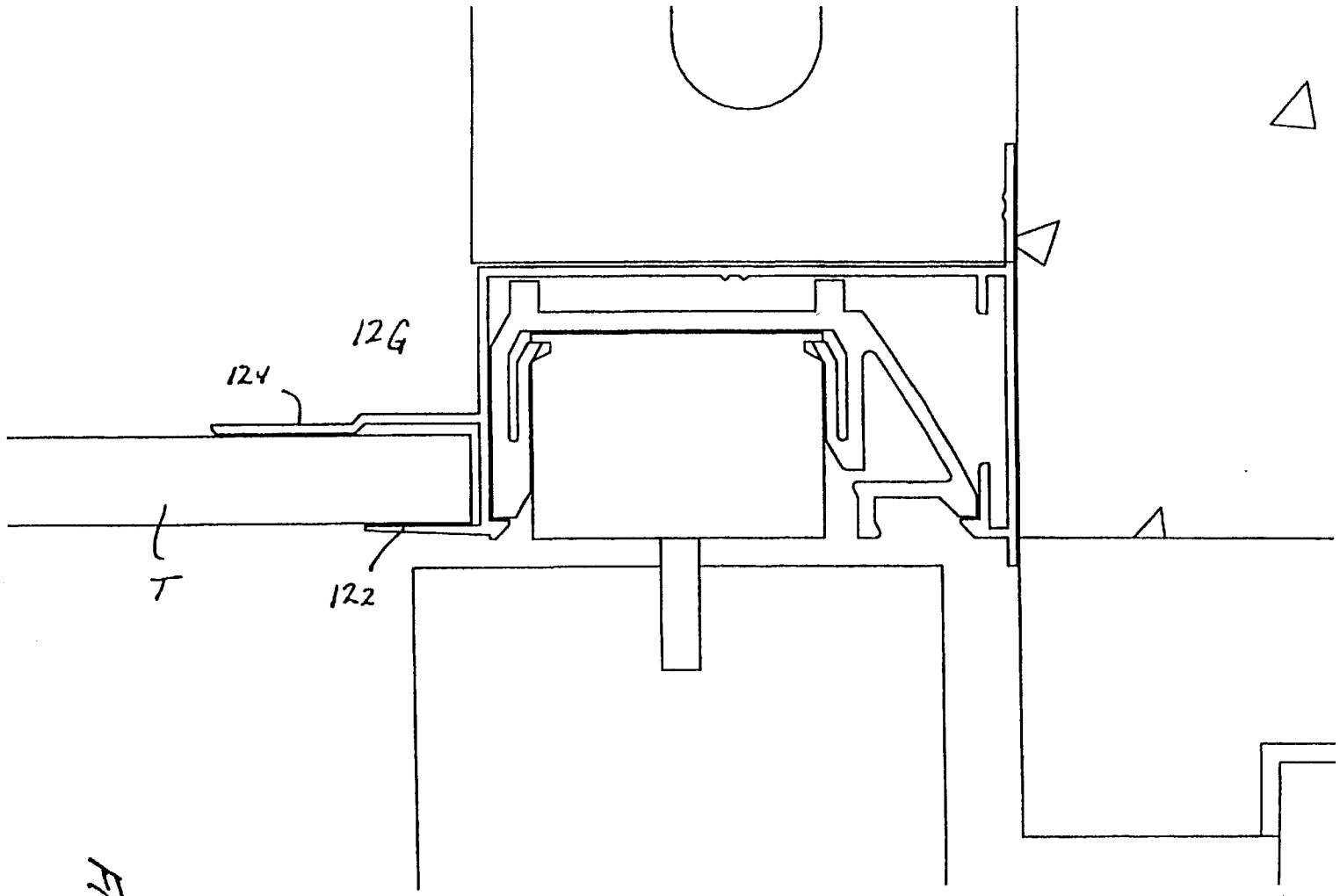
FIG. 11 is a sectional view of an alternate embodiment of a pocket member installed together with a bracket supporting a vertical blind.

FIG. 11 illustrates pocket member 12G which is similar to pocket member 12F, except from the front portion thereof a lower flange 122 extends which supports a ceiling panel wallboard or tile T. Also, an upper flange 124 extends above lowered flange, together, flanges 122, 124 form a channel for securely holding the tile T. In this embodiment the window treatment holder system 10 is substantially concealed within the ceiling of the structure.

Figure 12:
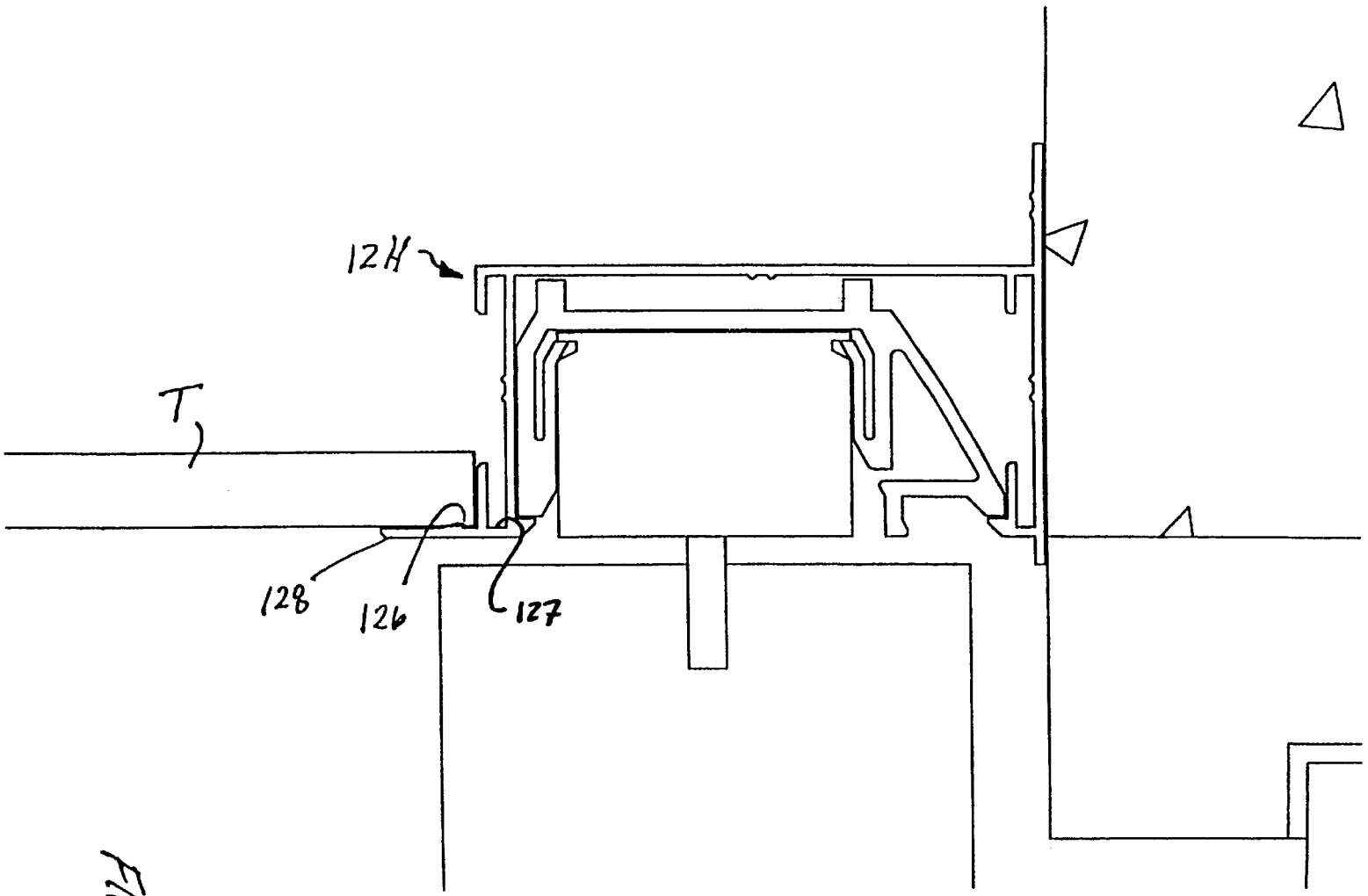
FIG. 12 is a sectional view of a pocket member and bracket of the present invention, where the pocket member is installed and the bracket is supporting a vertical blind set.
Figure 13A:
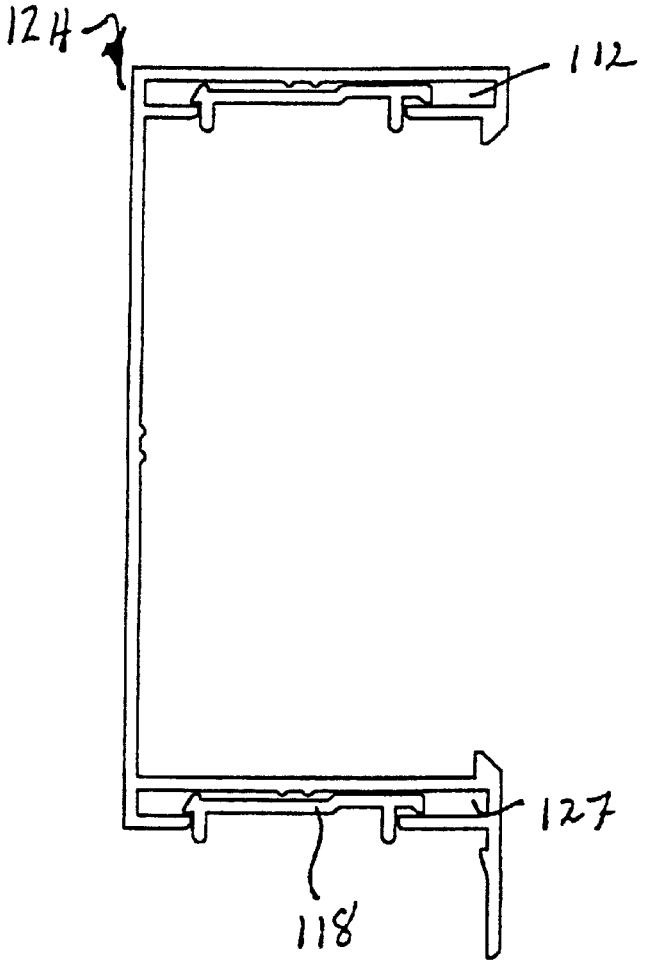
FIG. 13A is a view of an alternate embodiment pocket member.
Figure 13B:
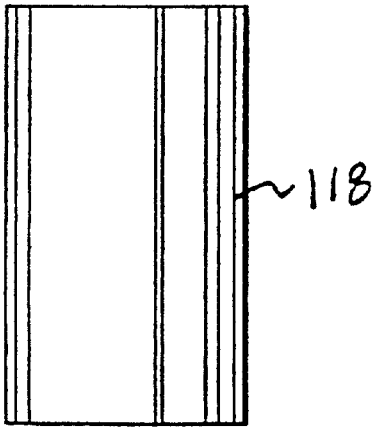
FIG. 13B is a side elevational view of a splicing member of the present invention illustrating use of the splicing member for adjoining adjacent pocket members.

FIG. 12 illustrates pocket member 12H, which is similar to pocket member 12G, except member 12H includes a channel 127 in the front portion thereof for receipt of a joining member 118, and also includes a barb 126 on an L-shaped ledge 128 for supporting the edge of a ceiling panel, such as wallboard, sheetrock, etc. or tile T. FIG. 13A illustrates a sectional view of pocket member 12I having a joining member, or splices, 118 in channels 112 and 127 thereof, and FIG. 13B illustrates splice 118 in isolation.

Figure 14A:
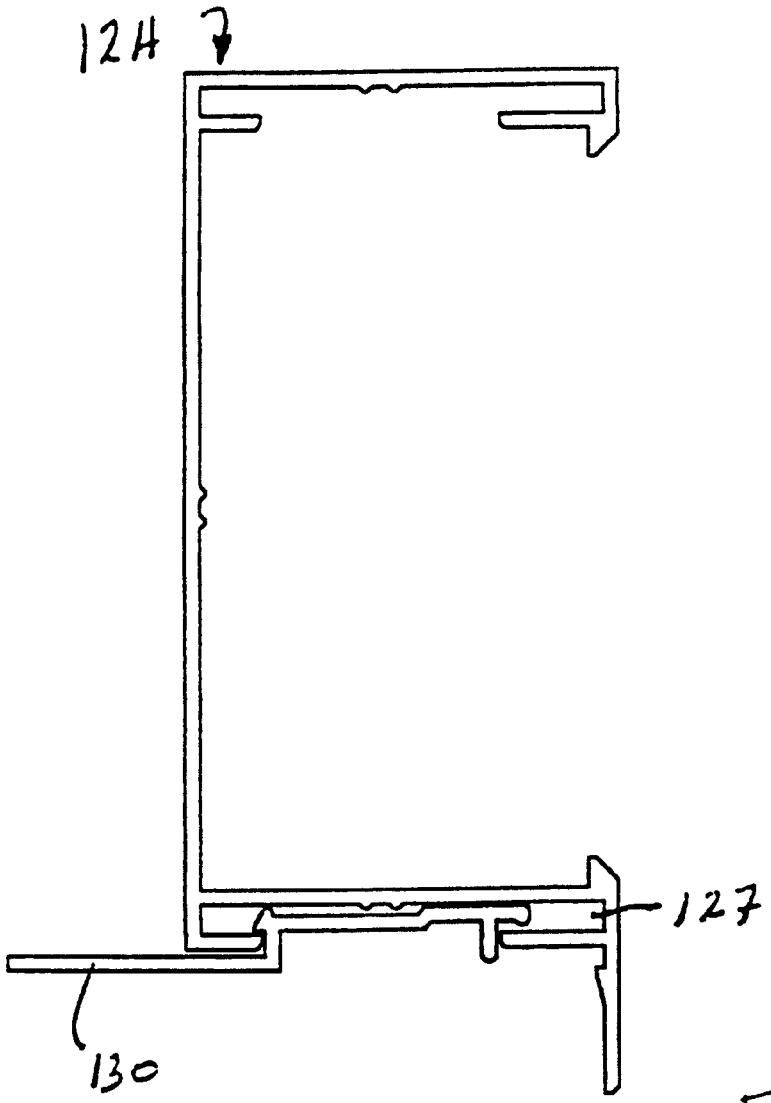
FIGS. 14A is a view of the pocket member of FIG. 13A.
Figure 14B:
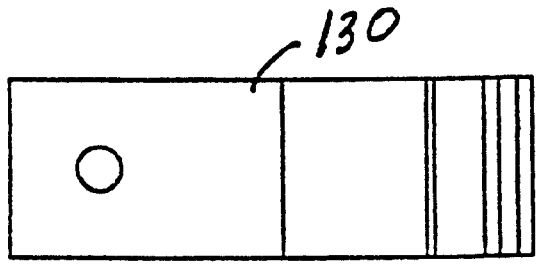
FIG. 14B is a side elevational view of a hanger member for use therewith.

FIGS. 14A and 14B illustrate pocket member 12H with a hanger member 130 provided in channel 127 thereof for supporting the forward end of pocket member 12H from above.

Figure 15:
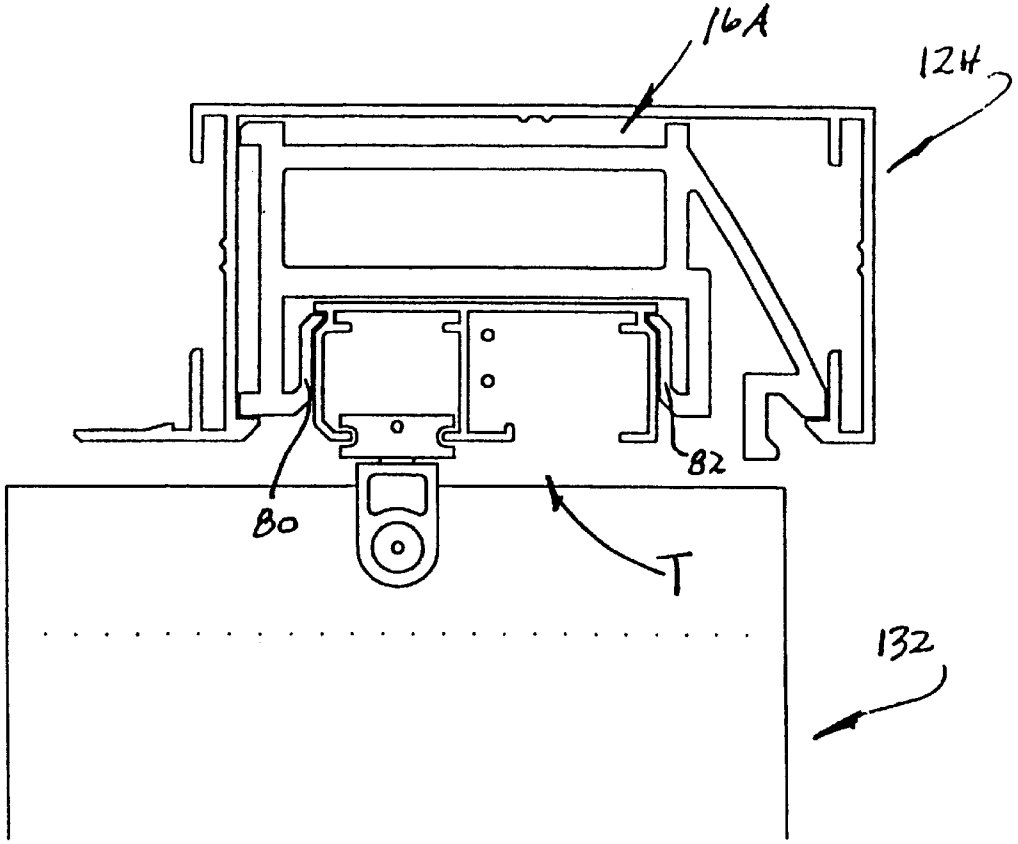
FIG. 15 is a sectional view of the pocket member of FIG. 13 and bracket of the present invention in use with an S-fold drapery and track.

FIG. 15 illustrates pocket member 12H with a bracket 16A which has been modified to provide a wider recess between arms 80 and 82 in order to accept a track, generally T, for S-fold draperies 132 the draperies 132 and track T being of conventional design.

Figure 16:
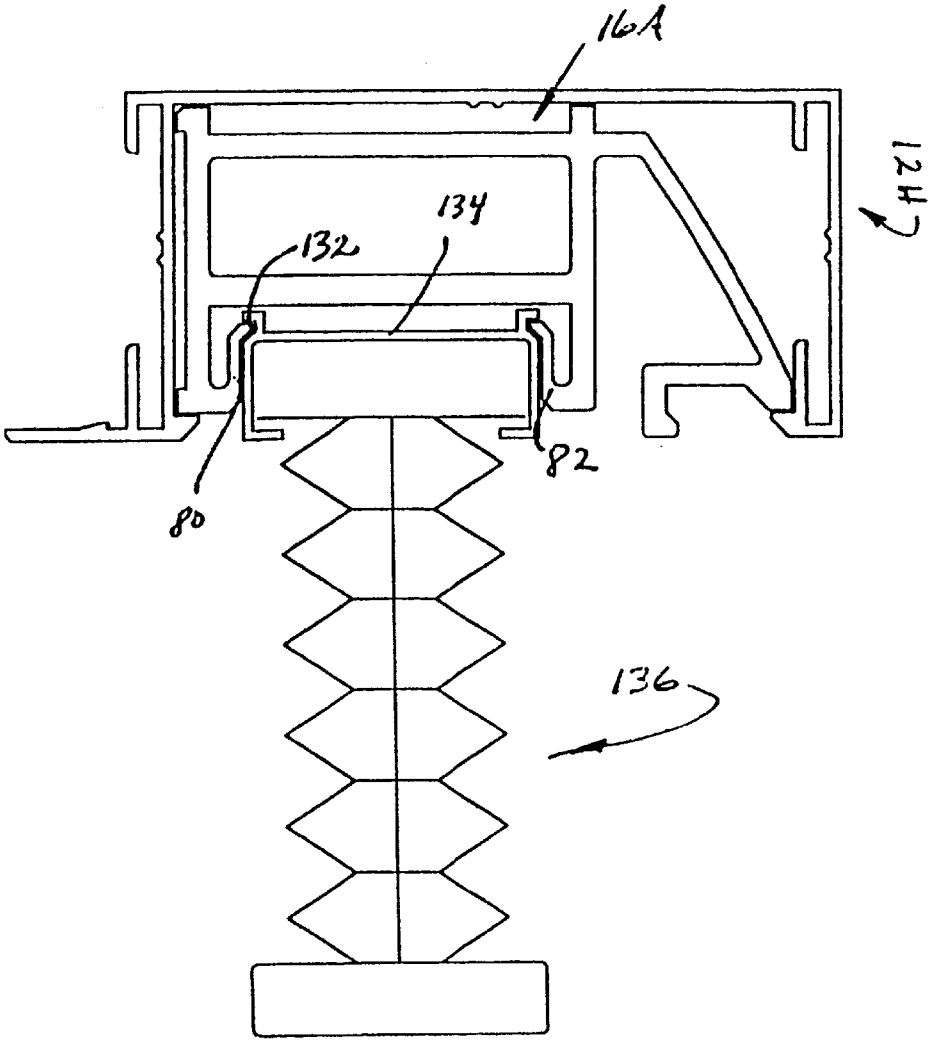
FIG. 16 is a sectional view of the pocket member of FIG. 13 and bracket of the present invention illustrating holding a cellular shade.

FIG. 16 illustrates a pocket member 12H and a bracket 16A which has been modified such that legs 80 and 82 engage with grooves 132 in the head rail 134 of a conventional cellular shade 136.

Figure 17:
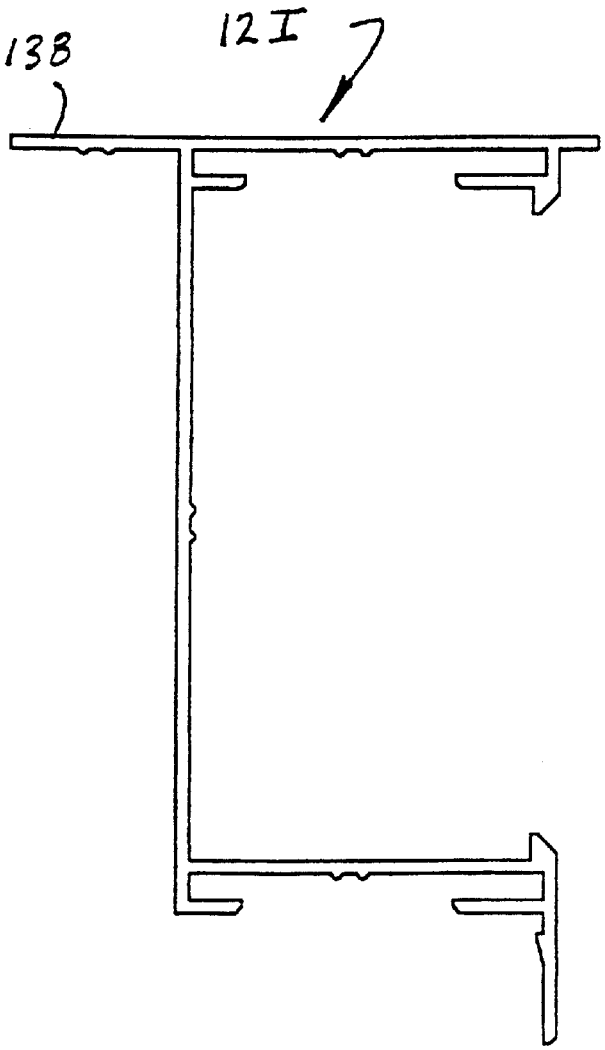
FIG. 17 is a sectional view of an alternate embodiment pocket member for use in mounting on a wall.

FIG. 17 illustrates a pocket member 12I, which is similar to pocket member 12H, except that pocket member 12I includes an upstanding rear flange 138 for allowing the rear portion of pocket member 12I to be attached to a wall by the driving of fasteners through flange 138.

Figure 18:
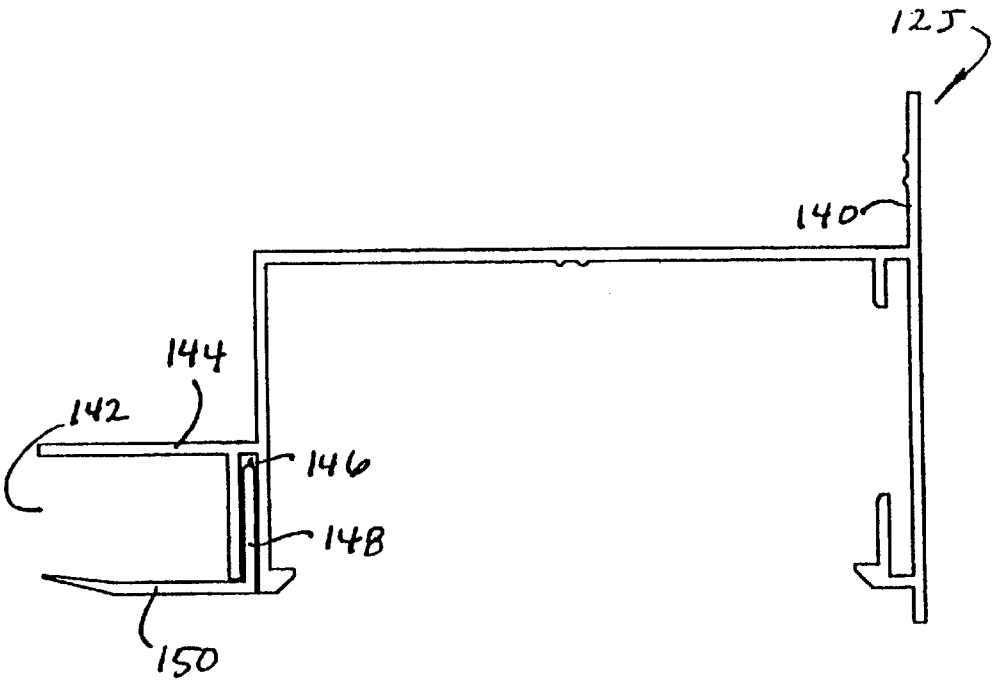
FIG. 18 is a sectional view of an alternate embodiment pocket member for use with a ceiling board or tile.

FIG. 18 illustrates a pocket member 12J having a rear wall attachment flange 140 and a channel 142 formed on the front portion thereof by an outwardly extending flange 144 which includes a channel 146 for receipt of a leg 148 of an L-shaped edge member 150. Member 150 could provide an interface between the edge of a ceiling panel, such as wallboard, sheetrock, etc., or tile T and pocket member 12J, with the interaction of leg 148 and channel 146, being an interference fit.

Figure 19:
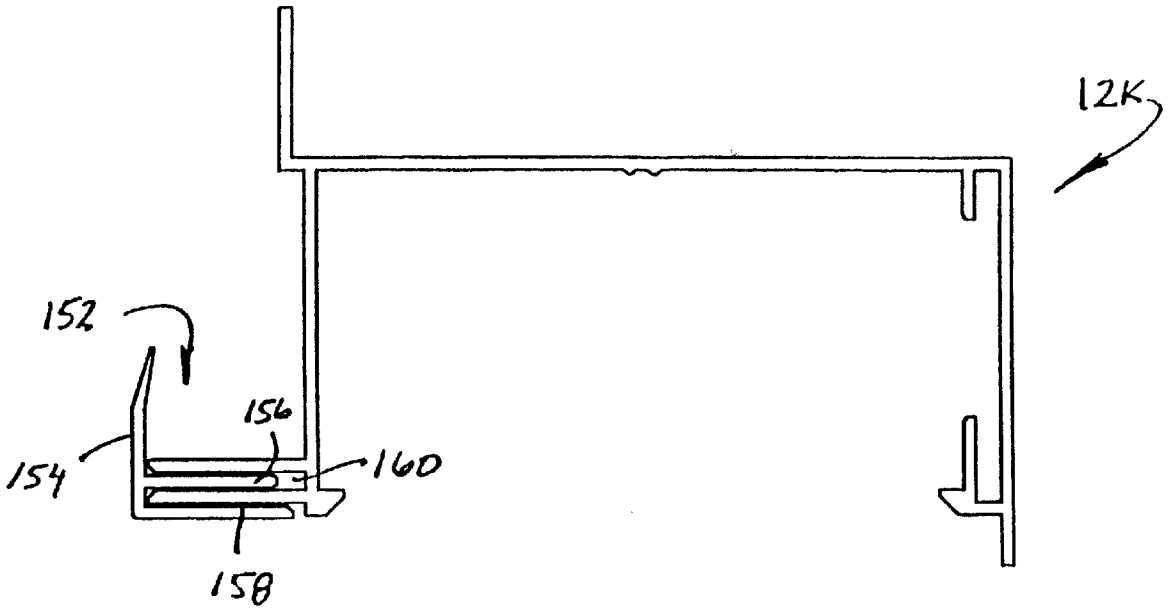
FIG. 19 is a sectional view of an alternate embodiment pocket member of the present invention for use with a vertical board, panel, or tile member.
Figure 20B:
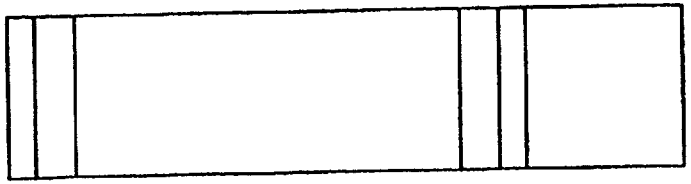
FIGS. 20A, 20B, 20C, and 21 are various views of the bracket of FIG. 6.
Figure 20A:
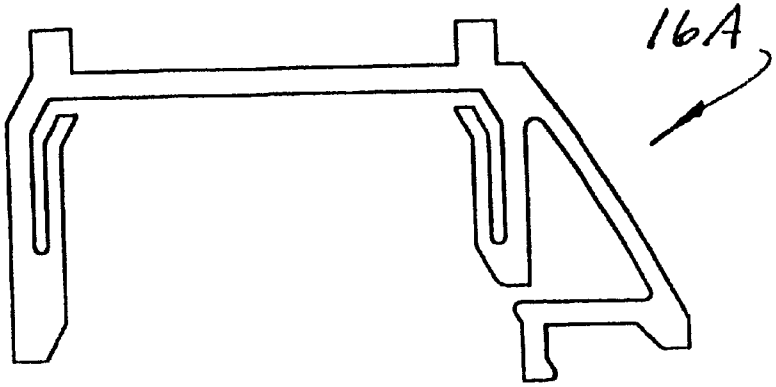
Figure 20C:
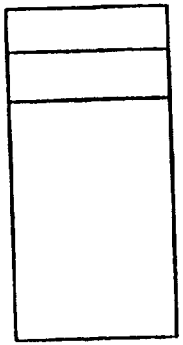
Figure 21:
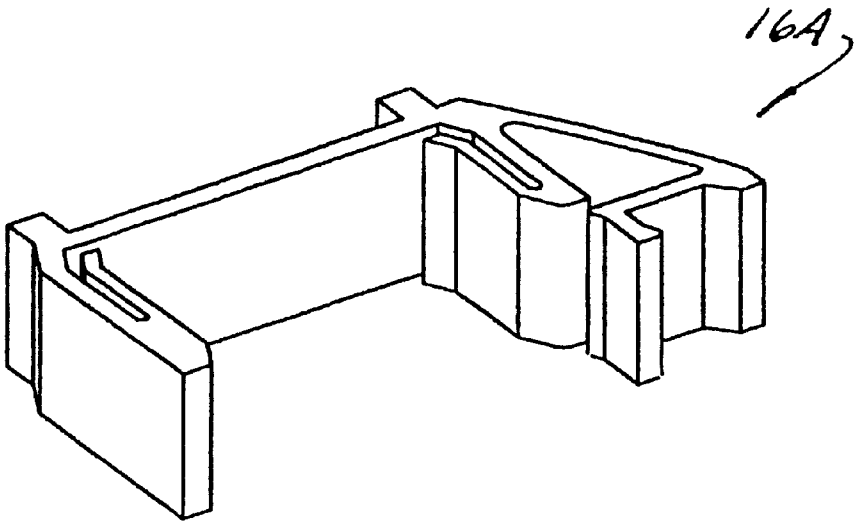

FIG. 19 illustrates a pocket member 12K having a channel 152 in the forward portion thereof for receipt of a vertical wall panel (not shown). Channel 152 is expandable by virtue of a fascia member 154 having legs 156, 158 receivable in channel 160 of pocket member 12K through an interference fit.

FIGS. 20A–20C and 21 illustrate various views of a bracket member 16A which is similar to bracket 16A of FIG. 2, except that chamber 95 found in bracket 16A is eliminated.

Figure 22:
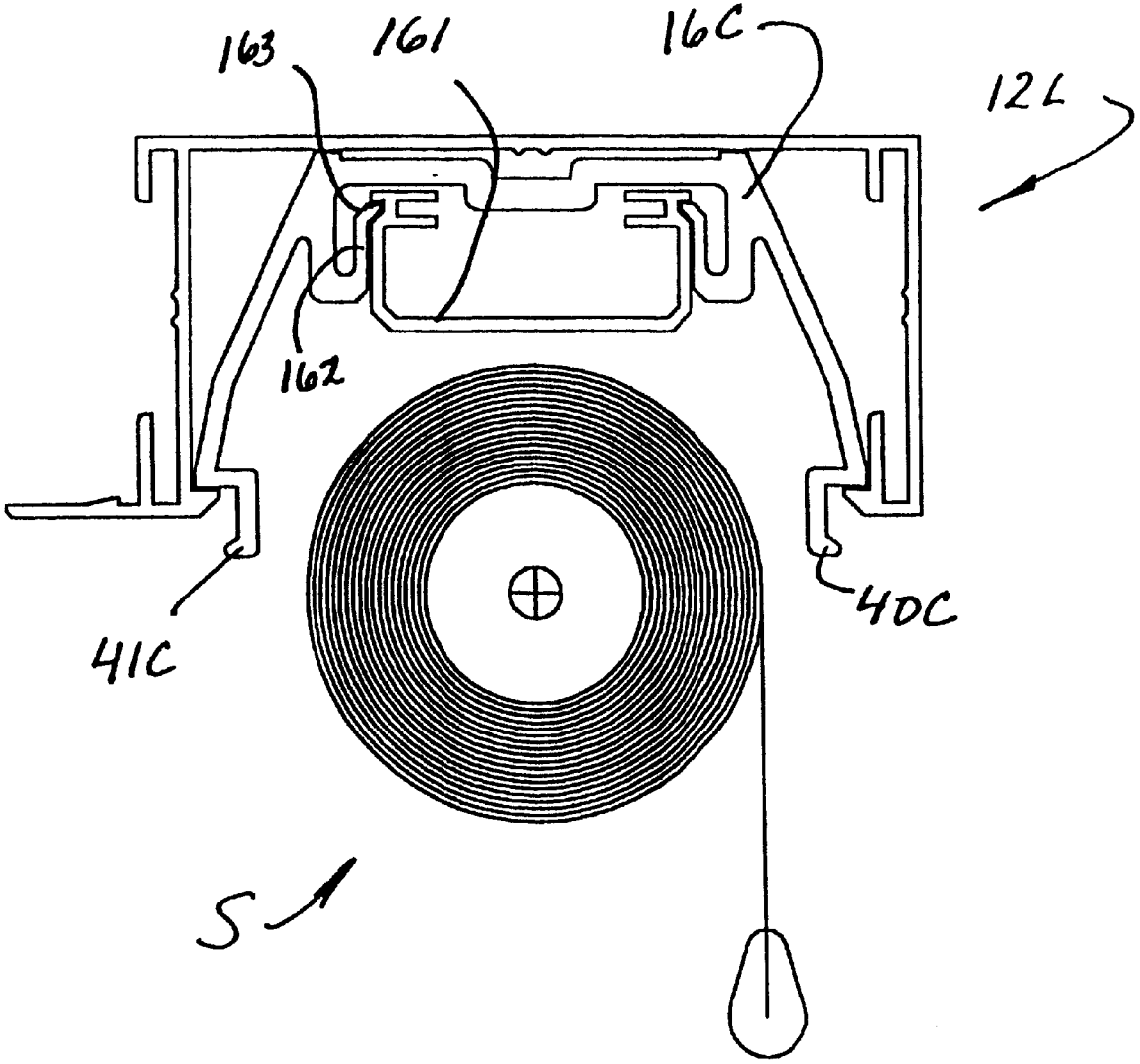
FIG. 22 is a sectional view of the pocket member of FIG. 13 and bracket of the present invention in use with a roll shade.

FIG. 22 illustrates pocket member 12L, having a bracket 16C therein configured for holding a rail 161 of a conventional roll shade, generally S. Bracket 16C includes a flexible catch 40C and a flexible catch 41C, one being provided at each end of bracket 16C for releasably fastening roll shade within pocket member 12L. Bracket 16 further includes flexible arms 162 for engaging grooves 163 of rail 161.

Figure 23:
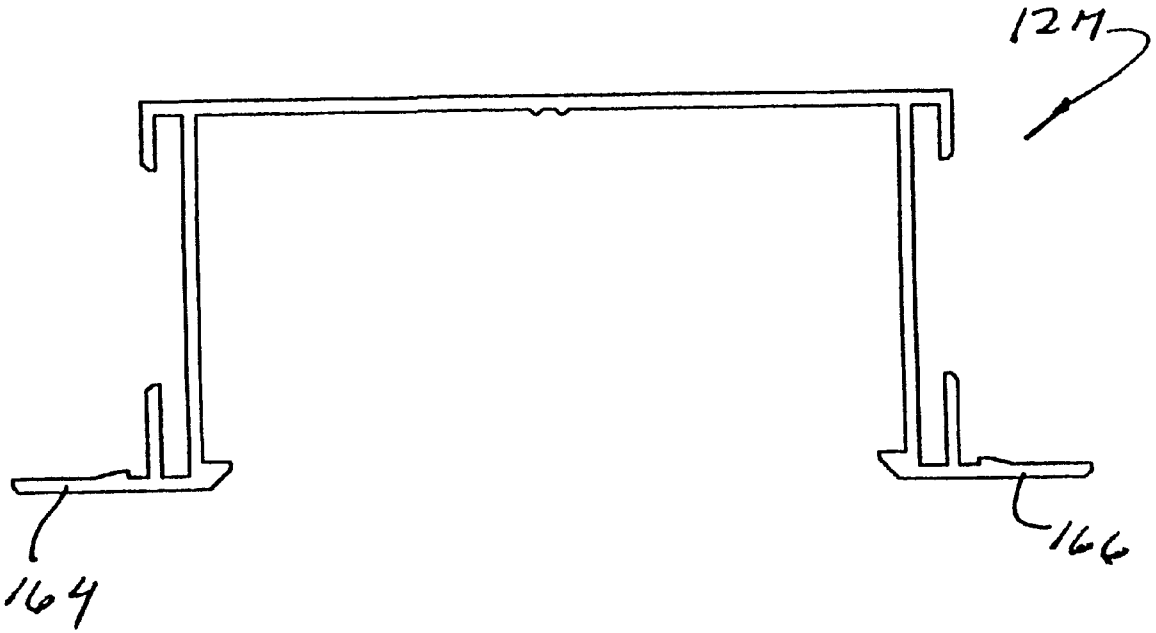
FIG. 23 is a sectional view of an alternate embodiment pocket member of the present invention for use with a ceiling tile installation.

FIG. 23 illustrates a pocket member 12M having outwardly extending flanges 164 and 166 for supporting the edges of ceiling tile panels (not shown).

Figure 24:
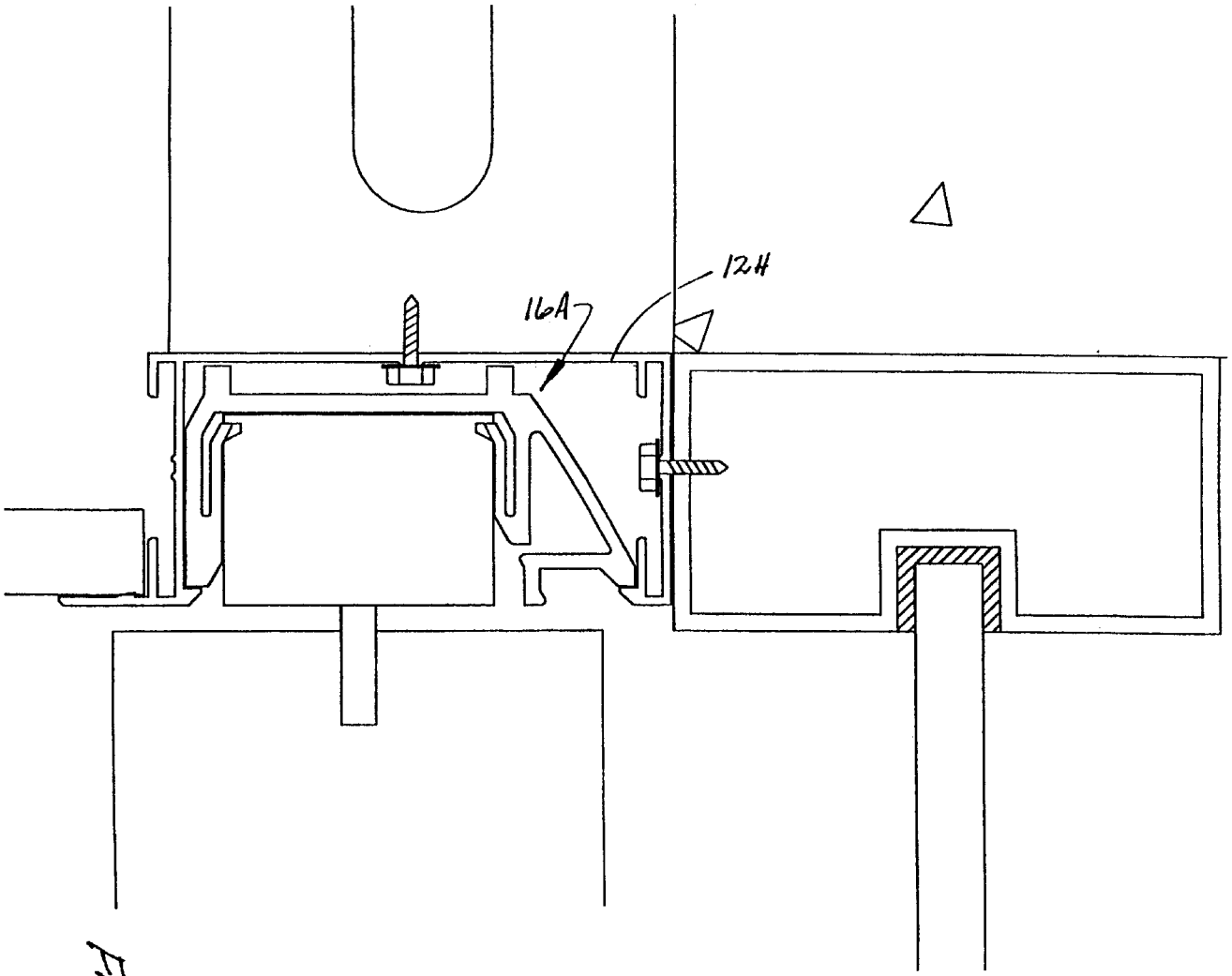
FIG. 24 is a sectional view of the pocket member of FIG. 13 and bracket of the present invention supporting a vertical blind set, the pocket member being attached to the face of a mullion and overhead, and additionally supporting a ceiling tile or panel.

FIG. 24 illustrates installation of a pocket member 12H having a bracket 16A holding a set of vertical blinds V.

Figure 25:
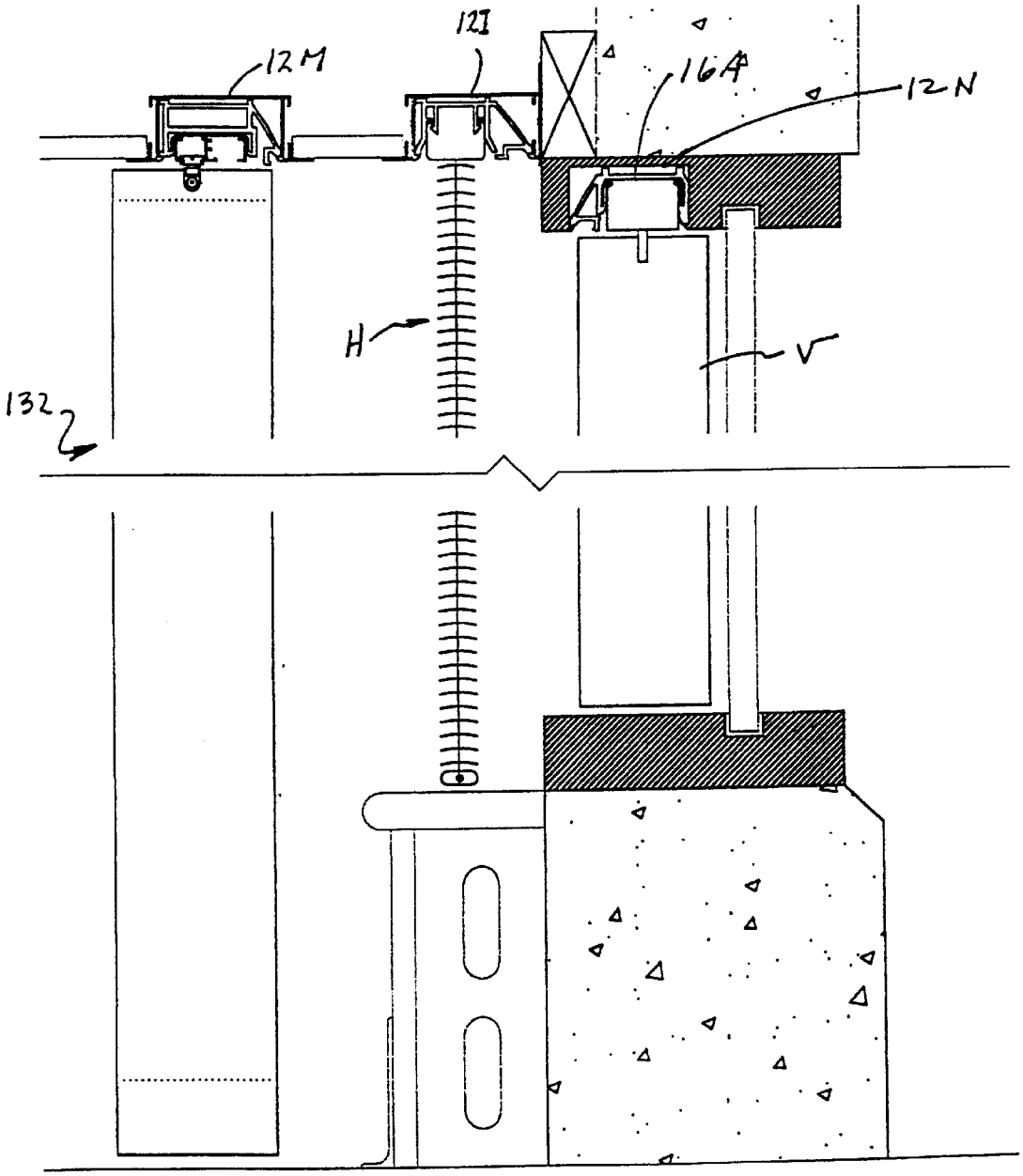
FIG. 25 is a sectional view of pocket members and brackets of the present invention illustrating the mounting of a drapery set, a horizontal blind set, and a vertical blind set.
Figure 26A:
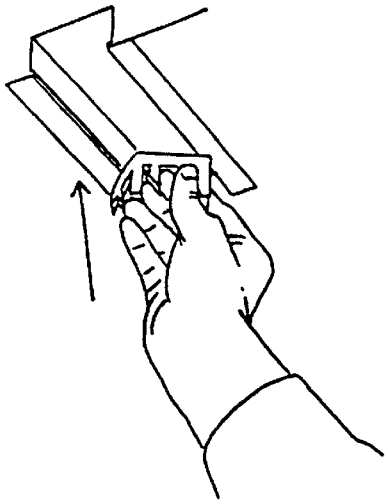
FIGS. 26A–26D are a series of views showing the steps of using the window treatment holding system of the present invention and involves inserting brackets of the present invention into a pocket of the present invention and then attaching the window treatment to the brackets.
Figure 26B:
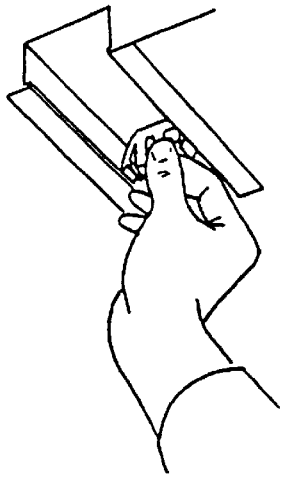
Figure 26C:
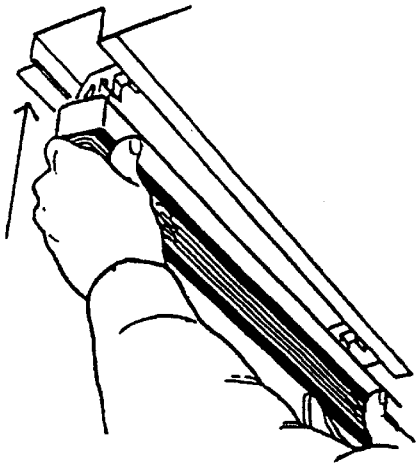
Figure 26D:
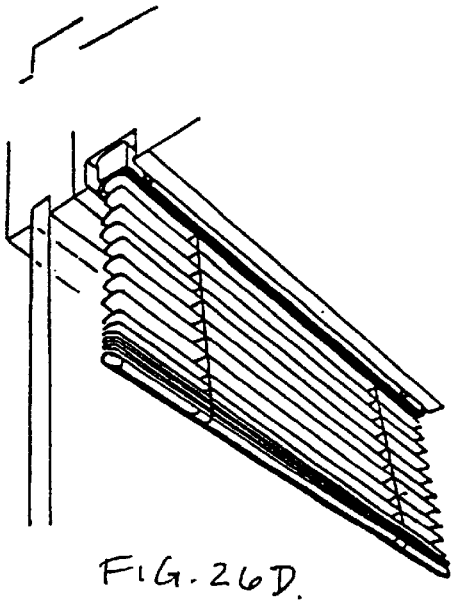

FIG. 25 is a composite figure illustrating a pocket member 12M with a bracket member such as bracket member 16A holding a set of draperies. Also illustrated in FIG. 25 is a pocket member 12I having a bracket 16 supporting horizontal blinds H. Finally, FIG. 25 illustrates a pocket member 12N which is formed integrally with the upper window frame. A bracket member such as a bracket 16A is used to support vertical blinds V.

FIGS. 26A–26D illustrate a method of installing a window treatment, such as horizontal blinds, into a pocket member constructed in accordance with the present invention. The method includes installing a bracket into the pocket member and then snapping the headrail of the blinds into the bracket.

Figure 27:
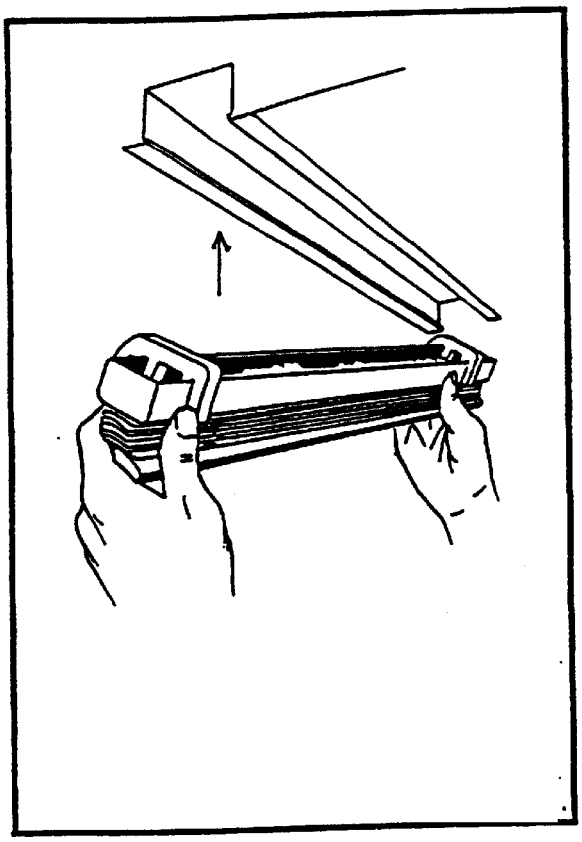
FIG. 27 is a view showing use of the window treatment holding system of the present invention and involves attaching brackets of the present invention to a window treatment and then inserting the brackets into a pocket.

FIG. 27 illustrates another method of installing a window treatment, such as horizontal blinds referenced in FIGS. 26A–26D, into a pocket member. The method includes first installing one or more brackets onto the window treatment and then, inserting the window treatment into the pocket member and snapping the headrail of the blinds into the bracket.

Figures 28A, 28B:
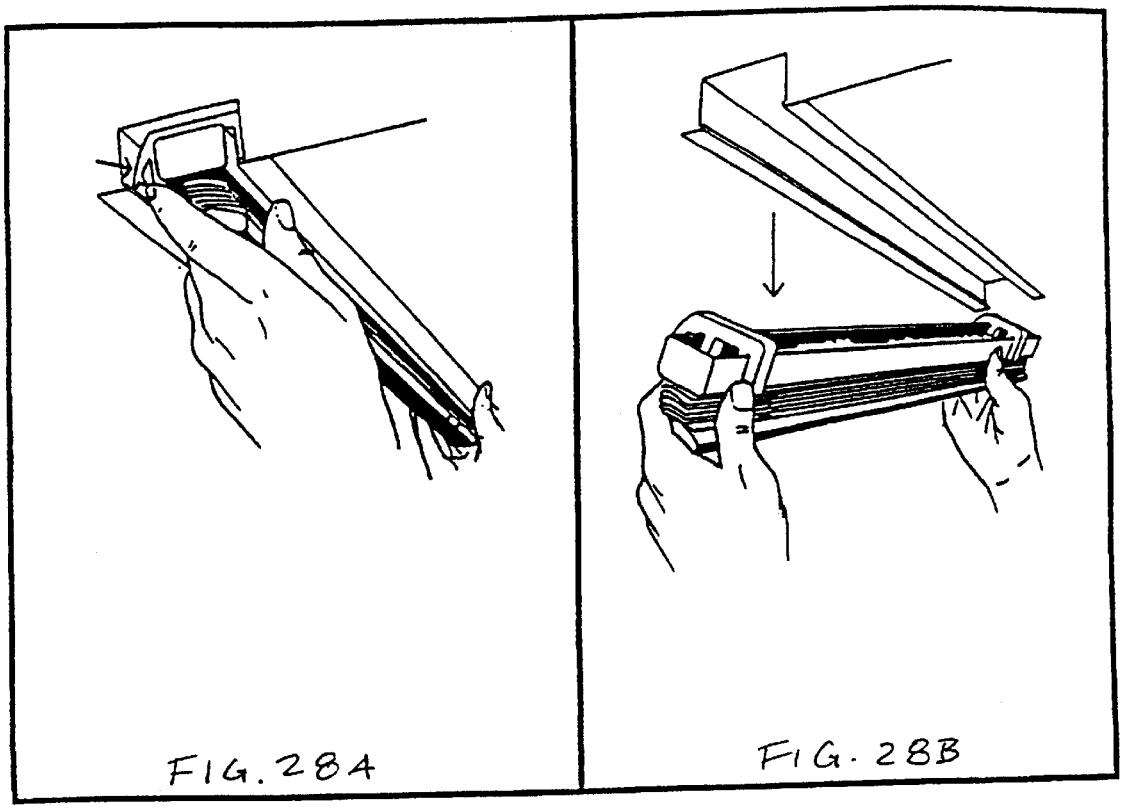
FIGS. 28A and 28B are a series of views showing the steps of removing a window treatment and bracket from a pocket of the present invention.

FIGS. 28A and 28B illustrate a method of removing and window treatment/bracket combination from a pocket. Removal steps include depressing the resilient tab, such as catch, or tab, 40A of bracket 16A, such that it clears a ledge of the pocket member to allow withdrawal of the bracket and window treatment from the pocket.

Figure 29:
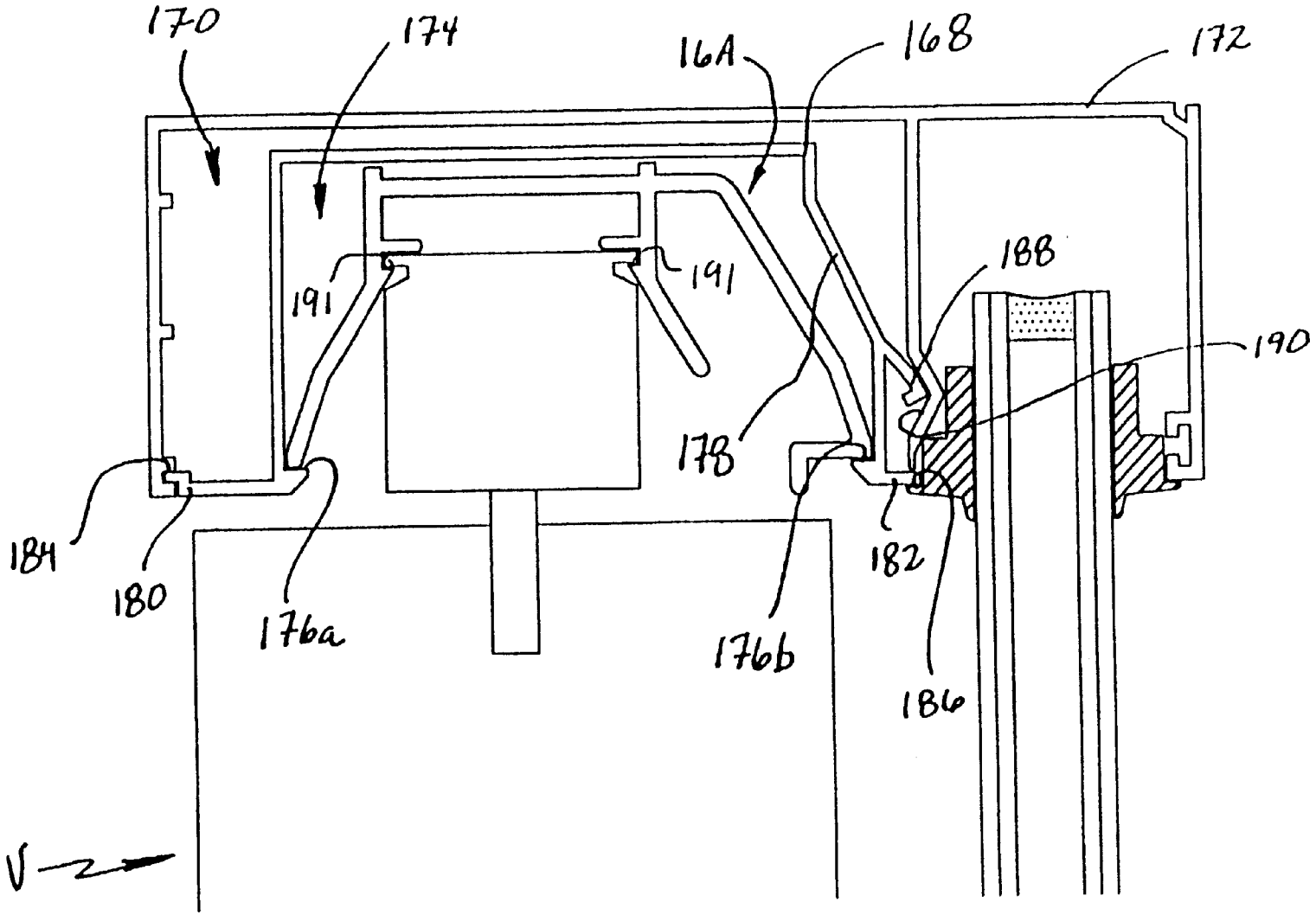
FIG. 29 is a sectional view of a pocket adapter constructed in accordance with the present invention for insertion into a cavity and for receiving a bracket constructed in accordance with the present invention.

FIG. 29 illustrates an additional element of the resent invention. Pocket adapter 168 can be inserted and snapped into place within a cavity 170 of a conventional mullion member 172. Once in place, pocket adapter 168 provides a pocket profile in accordance with the present invention, having its own cavity 174 and support ledges 176*a* and 176*b*.

Pocket adapter 168 includes resilient arm 178 and lips 180, 182 for engaging groove 184 and landing 186, respectively of mullion 172 and may also include an elbow portion 188 for engaging recess 190 of mullion 172. A bracket, such as bracket 16A, is readily receivable in adapter 168 and includes tracks 191 for supporting a window treatment such as a vertical blind set V.

Although one embodiment of pocket adapter 168 has been shown in use with one particular style of mullion, it is to be understood that pocket adapter 168 could be changed and reconfigured as necessary to work in a variety of other mullion designs.

Figure 30:
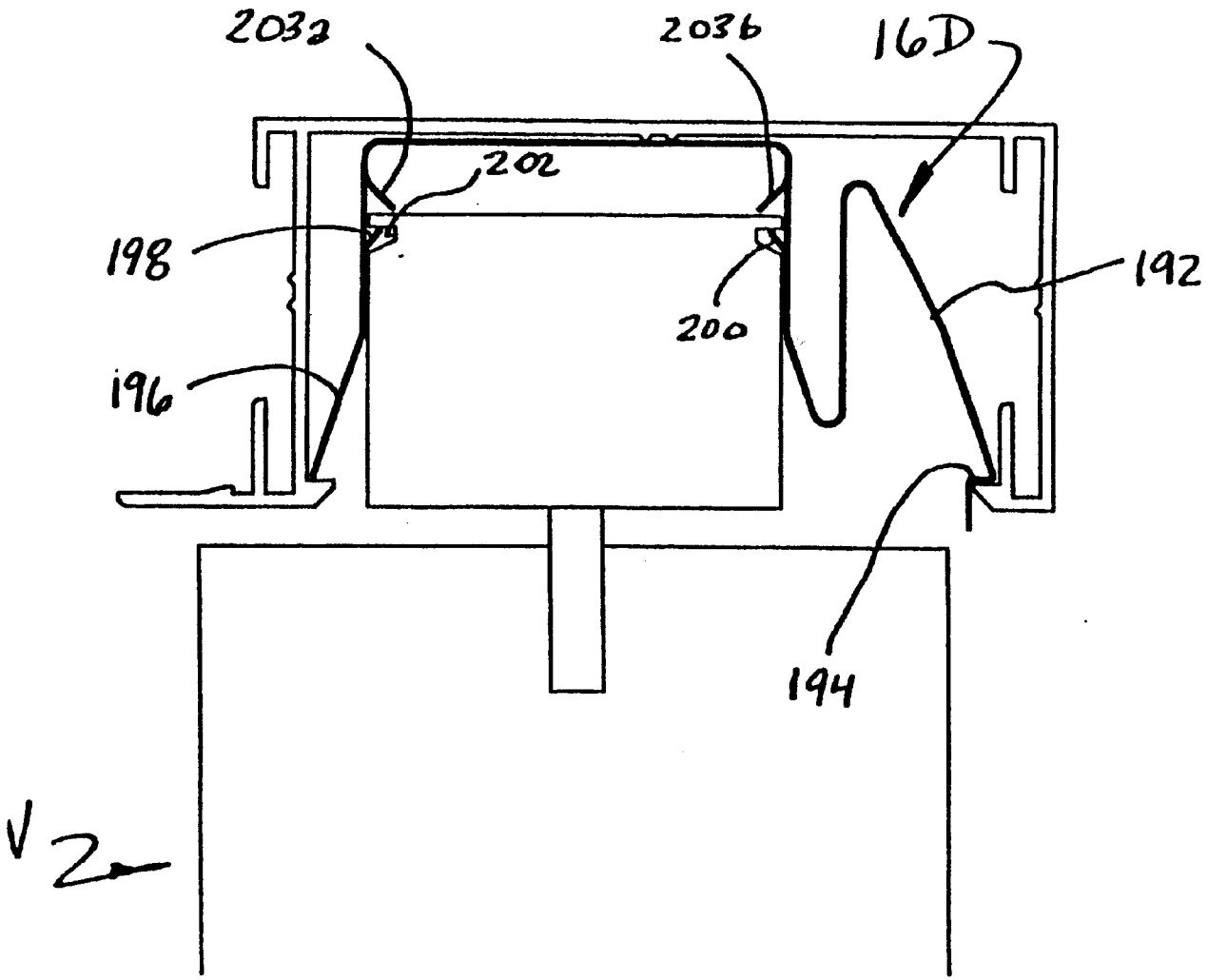
FIG. 30 is a sectional view of an alternate embodiment bracket of the present invention constructed of a band of resilient material.

FIG. 30 illustrates another alternate embodiment of a bracket of the present invention. In this embodiment, bracket 16D is formed of one or more bands of flexible, resilient material, such as a band of spring steel, plastic, etc. Bracket 16D performs the same function as other brackets described herein in retaining a window treatment to a pocket.

Bracket 16D could be stamped and bent into the shape illustrated in FIG. 30, or into a variety of other acceptable shapes (not shown) for snap-fit insertion into a pocket member. Bracket 16D includes a generally S-shaped leg 192 terminating in a catch or tab 194. Catch 194 engages a ledge of the pocket member, and bracket 16D includes an angled leg 196 for engaging another ledge of the pocket member. Further, bracket 16D includes tabs 198, 200 for engaging recesses 202 of a conventional window treatment, and tabs 203*a* and 203*b* for limiting upward movement of the window treatment, which may include a vertical blind set as V shown in FIG. 30.

Release of bracket 16D from the pocket would be accomplished by depression of catch 194 such that catch 194 clears the ledge of the pocket member.

Figure 31B:
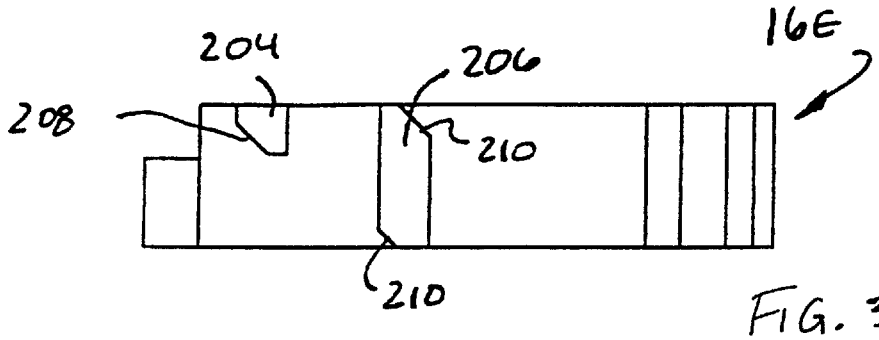
FIGS. 31A and 31B are a sectional view and a bottom plan view, respectively, of an alternate embodiment bracket of the present invention which can be twisted into place on a window treatment.
Figure 31A:
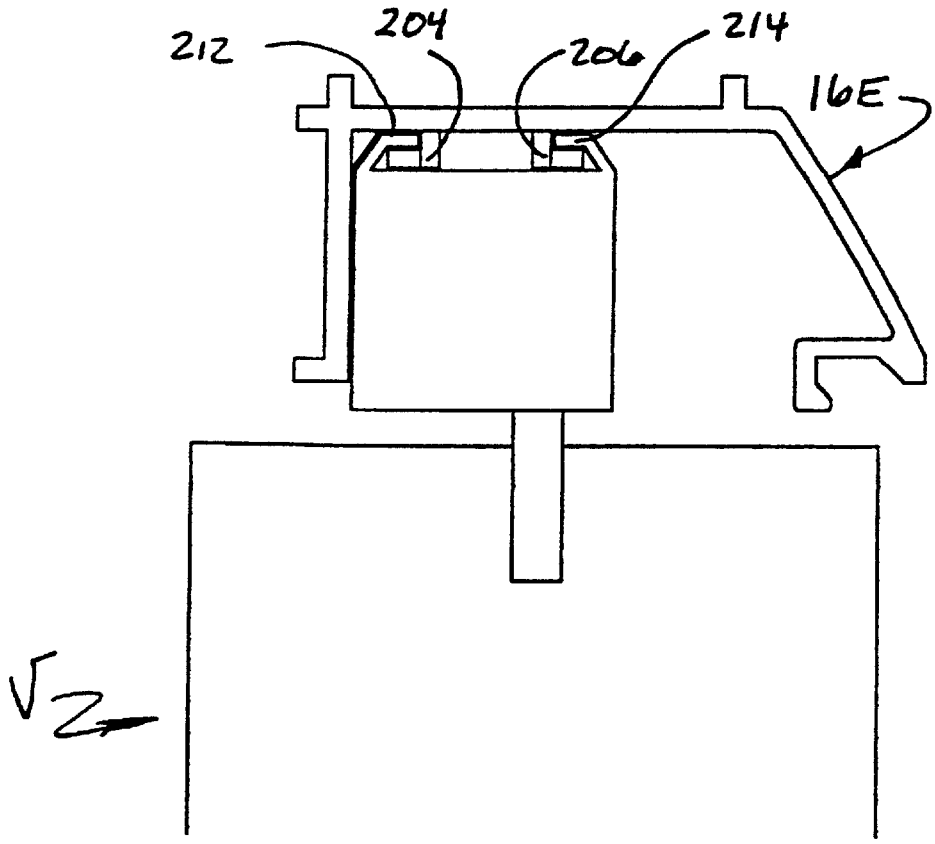
Figure 32C:
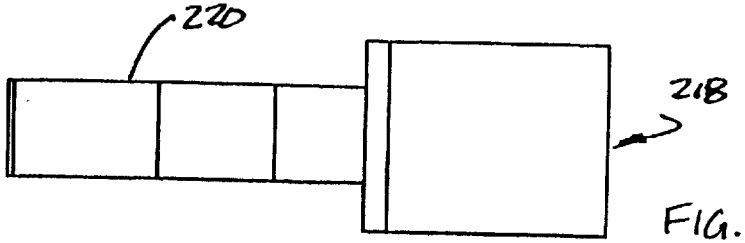
FIGS. 32A–32E illustrate plan and side elevational views of a two-piece bracket constructed in accordance with the present invention for use in a pocket of the present invention.
Figure 32D:
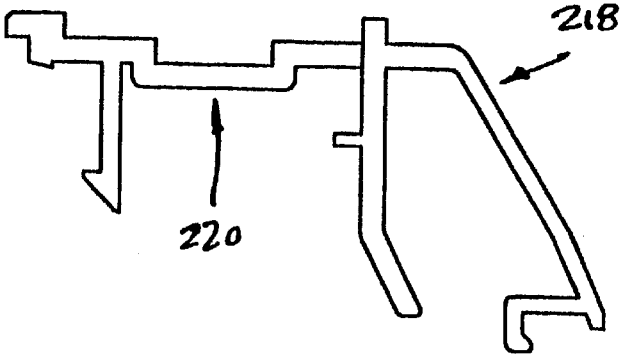
Figure 32E:
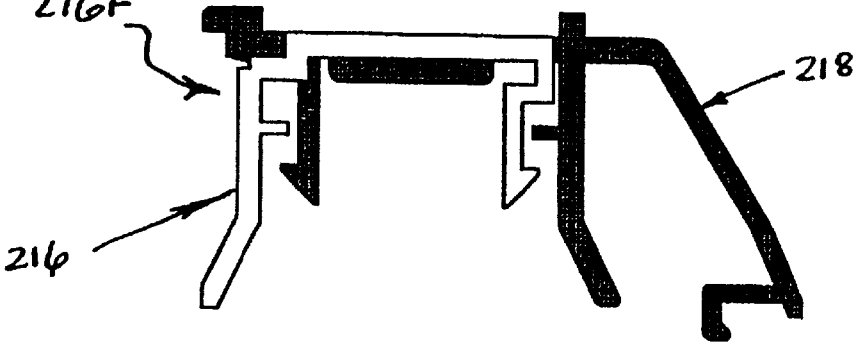
Figure 32A:
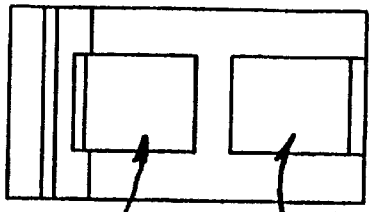
Figure 32B:
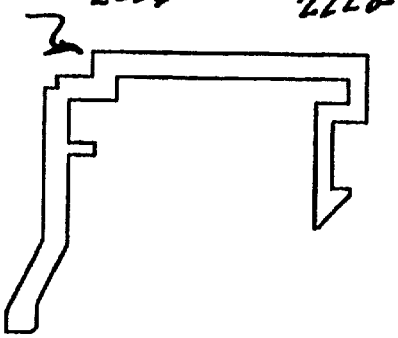

FIGS. 31A and 31B illustrate a sectional and bottom plan view of a further alternate embodiment of the present invention. Bracket 16E is configured to allow for the headrail of a conventional window treatment to be twisted into place onto bracket 16E. Bracket 16E includes downwardly extending L-shaped tracks 204, 206 having angled end portions 208, 210, respectively, which allow for the bracket 16E to be twisted into place in the headrail of a window treatment, such as vertical blinds V shown in FIG. 30. Once twisted into place, tracks 204, 206 engage with flanges 212, 214, respectively to retain the window treatment to the pocket.

FIGS. 32A–32E include sectional and plan views of yet another alternate embodiment. In this embodiment, bracket 16F is comprised of two portions 216, 218 which connect to one another in an interlocking relationship. Portion 218 includes a tongue 220 which is received in passages 222*a* and 222*b* of portion 216 and once received therein, interlocks the portions 216, 218 together. Tongue 220 include a channel 224 which receives a crossmember 226 of portion 216 in an interlocking relationship. Once locked together, the portions 216, 218 form bracket 16F which resembles and functions as do the other brackets disclosed herein to releasably support a window treatment in a pocket member of the present invention.

From the foregoing, it can be seen that the present invention provides a versatile window treatment holding system which can find widespread applicability with substantially all major categories of window treatment types and a wide variety of window frames and mullions.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present invention.

What is claimed is:

1. A window treatment holder in combination with a window treatment, comprising:

said window treatment comprising an elongated support member and a window covering depending therefrom;

an elongated pocket member defining a bracket channel and at least one engagement surface on one side of said channel;

a bracket having at least one attachment member attached to the elongated support member, said bracket having an intermediate portion and at least one projection extending from said intermediate portion engageable with said engagement-surface of said pocket member; and said bracket being receivable in said channel and said projection of said bracket being resiliently biased outwardly away from said intermediate portion of said bracket, such that upon insertion of said bracket into said channel, said projection springs into resilient engagement with said engagement surface to secure said bracket in said channel.

2. A window treatment holder as defined in claim 1, wherein said at least one engagement surface includes a first longitudinally extending ledge on one side of said channel and a second longitudinally extending ledge on the other side of said channel.

3. A window treatment holder as defined in claim 1, wherein said at least one projection includes first and second projections extending outwardly from said intermediate portion.

4. A window treatment holder as defined in claim 1, wherein said bracket is generally elongated and defines a window treatment receiving portion asymmetrically positioned along said bracket.

5. A window treatment holder as defined in claim 1, wherein said bracket further includes at least one attachment member includes two generally upwardly extending projections for engaging and attaching the bracket to the window treatment.

6. A window treatment holder as defined in claim 1, wherein said pocket member includes a decorative molding profile integral therewith.

7. A window treatment holder as defined in claim 1, wherein said pocket member includes a detachable decorative molding profile.

8. A window treatment holder as defined in claim 1, wherein said pocket member includes a wall board channel.

9. A window treatment holder as defined in claim 1, wherein said pocket member includes a ceiling panel support surface.

10. A window treatment holder as defined in claim 1, further comprising a joining member for joining a plurality of pocket member together and said pocket member defining a joining member channel for receiving said joining member.

11. A window treatment holder as defined in claim 1, wherein said pocket member includes a hanger member for attaching said pocket member to a surface.

12. A window treatment holder as defined in claim 1, wherein said pocket member includes an fastening flange for attaching said pocket member to a surface.

13. A window treatment holder as defined in claim 1, wherein said pocket member includes an adjustable wall board channel.

14. The window treatment holder, as defined in claim 1, wherein said at least one attachment member of said bracket includes flanges attachable to the window treatment; said flanges being configured to attach said bracket to the window treatment through twisting of said flanges into locking engagement with the window treatment.

15. A window treatment holder in combination with a window treatment, comprising:

said window treatment comprising an elongated support member and a window covering depending therefrom;

an elongated pocket member defining a bracket channel and a first ledge on one side of said channel and a second ledge on the other side of said channel;

a bracket having at least one attachment member attached to the elongated support member, said bracket having a body portion defining a first projection engageable with said first ledge and a second projection engageable with said second ledge; and said bracket being receivable in said channel and said first projection of said bracket being resiliently biased outwardly away from said body portion of said bracket, such that upon insertion of said bracket into said channel, said first projection springs into resilient engagement with said first ledge to secure said bracket in said channel.

16. A window treatment holding system in combination with a window treatment, comprising:

said window treatment comprising an elongated support member and a window covering depending therefrom;

a body portion defining an elongated bracket channel and a first ledge on one side of said channel and a second ledge on the other side of said channel;

a bracket having at least one attachment member attached to the elongated support member, said bracket having a body portion defining a first projection engageable with said first ledge and a second projection engageable with said ledge; and said bracket being receivable in said channel and said first projection of said bracket being resiliently biased outwardly away from said body portion of said bracket, such that upon insertion of said bracket into said channel, said first projection springs into resilient engagement with said first ledge to secure said bracket in said channel.

17. A method for installing a window treatment, comprising an elongated support member and a window covering depending therefrom; comprising:

providing a window treatment;

providing an elongated channel having at least one ledge on one side of the channel;

providing a bracket separate from said window treatment attachable to the window treatment, the bracket having a body portion defining a projection engageable with the ledge, the projection of the bracket being resiliently biased outwardly away from the body portion of the bracket;

attaching the bracket to the elongated support member; and inserting the bracket in the channel such that the projection springs into resilient engagement with the ledge to secure the bracket in the channel.

18. A method for removing an installed window treatment, comprising:

providing an elongated having at least one ledge on one side of the channel;

providing a window treatment attached to a bracket, the window treatment comprising an elongated support member and a window covering depending therefrom, the bracket being separate from said channel and separable from said window treatment, said bracket to separate from both the elongated support member and said channel and carried in the channel and having a body portion defining a projection engaged with the ledge, the projection of the bracket being resiliently biased outwardly away from the body portion of the bracket;

depressing the first projection of the body portion such that the projection clears the ledge of the channel; and withdrawing the bracket from the channel.

19. A window treatment holder in combination with a window treatment, comprising:

said window treatment comprising an elongated support member and a window covering depending therefrom;

a mullion portion defining a mullion cavity;

an elongated pocket member defining a bracket channel and at least one ledge on one side of said channel; said pocket member having at least one attachment portion for attaching said pocket member in said mullion cavity;

a bracket having at least one attachment member attached to the elongated support member, said bracket having a body portion defining a projection engageable with said ledge; and said bracket being receivable in said channel and said projection of said bracket being resiliently biased outwardly away from said body portion of said bracket, such that upon insertion of said bracket into said channel, said projection springs into resilient engagement with said ledge to secure said bracket in said channel.

20. A window treatment holder in combination with a window treatment, comprising:

said window treatment comprising an elongated support member and a window covering depending therefrom;

a mullion portion;

said mullion portion defining an elongated pocket member having a bracket channel and at least one ledge on one side of said channel; a bracket having at least one attachment member attached to the elongated support member, said bracket having a body portion defining a projection engageable with said ledge; and said bracket being receivable in said channel and said projection of said bracket being resiliently biased outwardly away from said body portion of said bracket, such that upon insertion of said bracket into said channel, said projection springs into resilient engagement with said ledge to secure said bracket in said channel.

21. A window treatment holder in combination with a window treatment, comprising:

said window treatment comprising an elongated support member and a window covering depending therefrom;

an elongated pocket member defining a bracket channel and at least one engagement surface on one side of said channel;

a bracket separate from the window treatment and having at least one attachment member attached to the window treatment, said bracket having an intermediate portion and at least one projection extending from said intermediate portion engageable with said engagement surface of said pocket member; and said bracket being receivable in said channel and said projection of said bracket being resiliently biased outwardly away from said intermediate portion of said bracket, such that upon insertion of said bracket into said channel, said projection springs into resilient engagement with said engagement surface to secure said bracket in said channel.

22. A window treatment holder in combination with a window treatment, comprising:

said window treatment comprising an elongated support member and a window covering depending therefrom;

an elongated pocket member defining a bracket channel and at least one engagement surface on one side of said channel;

a bracket having at least one attachment member releasably attached to the elongated support member, said bracket having an intermediate portion and at least one projection extending from said intermediate portion engageable with said engagement surface of said pocket member; and said bracket being receivable in said channel and said projection of said bracket being resiliently biased outwardly away from said intermediate portion of said bracket, such that upon insertion of said bracket into said channel, said projection springs into resilient engagement with said engagement surface to secure said bracket in said channel.

* * * * *